US007370935B2

(12) United States Patent
Usuda

(10) Patent No.: US 7,370,935 B2
(45) Date of Patent: May 13, 2008

(54) DROPLET DISCHARGE DEVICE, DEVICE FOR MAINTAINING DISCHARGE PERFORMANCE OF HEAD, METHOD FOR MAINTAINING DISCHARGE PERFORMANCE OF HEAD, METHOD FOR MANUFACTURING ELECTRO-OPTICAL DEVICE, ELECTRO-OPTICAL DEVICE AND ELECTRONIC APPARATUS

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 396 days.

(21) Appl. No.: 11/101,457

(22) Filed: Apr. 8, 2005

(65) Prior Publication Data

US 2005/0237357 A1 Oct. 27, 2005

(30) Foreign Application Priority Data

Apr. 22, 2004 (JP) ..... 2004-126970

(51) Int. Cl.
*B41J 2/165* (2006.01)
*B41J 29/393* (2006.01)

(52) U.S. Cl. ..... 347/23; 347/19; 347/29; 347/30

(58) Field of Classification Search ..... 347/22, 347/23, 28, 29, 30, 32, 19
See application file for complete search history.

(56) References Cited

U.S. PATENT DOCUMENTS 5,455,608 A 10/1995 Stewart et al.
5,896,143 A * 4/1999 Matsui et al. ..... 347/24
6,036,299 A * 3/2000 Kobayashi et al. ..... 347/30
6,241,336 B1 * 6/2001 Muraki ..... 347/32
6,447,091 B1 * 9/2002 Calvo et al. ..... 347/19
6,494,560 B1 * 12/2002 Seshimo et al. ..... 347/23
6,719,400 B2 4/2004 Inui et al.
6,991,315 B2 1/2006 Nakamura et al.
7,182,815 B2 2/2007 Katagami et al.
2006/0146379 A1 7/2006 Katagami et al.

FOREIGN PATENT DOCUMENTS

JP A-10-95126 4/1998
JP A 10-95126 4/1998
JP A-2000-289229 10/2000

(Continued)

*Primary Examiner*—Shih-Wen Hsieh
(74) *Attorney, Agent, or Firm*—Oliff & Berridge, PLC

(57) ABSTRACT

A droplet discharge device is provided in which for a head having a plurality of nozzles, nozzle rows having clogged nozzles are detected in advance and suction is performed on the nozzle rows having clogged nozzles independently, thereby recovering the nozzles, while measures against the thickening of a liquid in nozzles can be carried out. A droplet discharge device includes: a head having a plurality of nozzle rows including a plurality of nozzles on a nozzle surface in order to discharge droplets of a supplied liquid; a non-discharge nozzle detector that detects which nozzle row of the plural nozzle rows has nozzles that are clogged so as to be a non-discharge nozzle; a suction device to seal a nozzle row including detected non-discharge nozzles on the nozzle surface and performing suction to eliminate the clogging of the non-discharging nozzles; and a moisture retaining device to seal the plural nozzle rows on the nozzle surface to retain the moisture of the nozzle surface.

12 Claims, 17 Drawing Sheets

FOREIGN PATENT DOCUMENTS

| | | |
|---|---|---|
| JP | A-2001-315351 | 11/2001 |
| JP | A-2002-273869 | 9/2002 |
| JP | A-2003-054006 | 2/2003 |
| JP | A-2003-266670 | 9/2003 |
| JP | A-2004-66810 | 3/2004 |
| KR | 10-0455964 | 6/2003 |

* cited by examiner

SUCTION SEQUENCE

SUCTION SEQUENCE

X-AXIS
79F
81
HEAD 11
NOZZLE SURFACE 70
ABSORBER 1752A
FIRST SUCTION CAP 1751A
SUCTION DEVICE 1300
1761A
1753A
WASTE LIQUID TANK 1754
301
MOTOR
Z1
Z2

LIQUID SUCTION OPERATION
X1
WIPING CLOTH 592
593
591
WIPING UNIT 500
WIPING BLADE 1850
Z

WIPING (CLEANING) OPERATION
CLEANING SEQUENCE

X-AXIS
HEAD 11
NOZZLE SURFACE 70
79F
79E
81
ABSORBER 1752B
SECOND SUCTION CAP 1751B
SECOND SUCTION CAP
SUCTION DEVICE 1300
1761A
1761B
1753B
P
WASTE LIQUID TANK 1754
MOTOR
301
Z1
Z2

LIQUID SUCTION OPERATION
X1
WIPING CLOTH 592
593
591
WIPING UNIT 500
WIPING BLADE 1850
Z

WIPING (CLEANING) OPERATION
CLEANING SEQUENCE

INFORMATION STORAGE 1810

| | TIME OF CAPPING (TC) IMMEDIATELY UNTIL DROPLET DISCHARGE OPERATION | TOTAL SUCTION AMOUNT FROM ONE NOZZLE ROW (1) (g) | TOTAL SUCTION AMOUNT FROM ONE NOZZLE ROW (2) (g) WHEN N2>5% (N2: RATE OF NON-DISCHARGE NOZZLE (DOT MISSING)) |
|---|---|---|---|
| MODE 1 | CLEANING CL OUTSIDE HOME POSITION (HP) (ABNORMAL) | 2.0 | 3.0 |
| MODE 2 | 0≦TC<3-DAYS(3D) | 0.2 | 0.4 |
| MODE 3 | 3-DAYS(3D)≦TC<1-WEEK(1W) | 0.6 | 1.2 |
| MODE 4 | 1-WEEK(1W)≦TC<1-MONTH(1M) | 1.0 | 2.0 |
| MODE 5 | 1-MONTH(1M)≦TC | 2.0 | 3.0 |

TOTAL SUCTION AMOUNT TABLE A (TIME OF CAPPING:TC)

FIG. 13

CAPPING FOR MOISTURE RETENTION

SEQUENCE AGAINST THICKENING OF LIQUID (PERIODICAL FLUSHING AND APPLICATION OF MICROVIBRATION)

DROPLET DISCHARGE DEVICE, DEVICE FOR MAINTAINING DISCHARGE PERFORMANCE OF HEAD, METHOD FOR MAINTAINING DISCHARGE PERFORMANCE OF HEAD, METHOD FOR MANUFACTURING ELECTRO-OPTICAL DEVICE, ELECTRO-OPTICAL DEVICE AND ELECTRONIC APPARATUS

BACKGROUND

Exemplary aspects of the present invention relate to a droplet discharge device to discharge droplets to a workpiece, a device to maintain the discharge performance of a head, a method to maintain the discharge performance of a head, a method to manufacture an electro-optical device, an electro-optical device and an electronic apparatus.

A droplet discharge device is often used as a drawing system. The drawing system discharges droplets to a workpiece by an ink jet method. The drawing system is sometimes used for manufacturing an electro-optical device, such as a flat panel display.

The droplet discharge device that discharges minute droplets by an ink jet system has a head to discharge droplets. The head is required to discharge minute droplets to a workpiece stably and accurately. Thus, a phenomenon of the clogging of plural nozzles in a head must be prevented to ensure the stable and accurate discharging of minute droplets. There has been proposed a technique (see Japanese Unexamined Patent Publication No. 10-95126 (p. 5, FIG. 9) in which in order to prevent nozzle clogging, cleaning treatment is carried out for the nozzle surface of a head by discharging droplets from the nozzles and, if necessary, perform suction on the nozzles.

SUMMARY

An image forming device based on an ink jet method disclosed in Japanese Unexamined Patent Publication No. 10-95126 (p. 5, FIG. 9) includes a plurality of capping members. Each cap member contacts closely with respective nozzles to perform suction on each nozzle independently. This structure allows suction through the cap members only from nozzle rows including nozzles in which a liquid is thickened, thereby eliminating the clogging of the nozzles.

However, Japanese Unexamined Patent Publication No. 10-95126 (p. 5, FIG. 9) discloses only a mechanical structure to perform suction from nozzle rows having nozzles with a thickened liquid therein independently of other nozzle rows. Which nozzle row includes clogged nozzles can not be specified in advance.

Exemplary aspects of the present invention are intended to address and/or solve the above and/or other problems and to provide a droplet discharge device, a device to maintain the discharge performance of a head, a method to maintain the discharge performance of a head, a method to manufacture an electro-optical device, an electro-optical device and an electronic apparatus. In the above devices, methods and apparatus, for a head having a plurality of nozzle rows, nozzle rows having clogged nozzles are detected in advance and suction is performed on the nozzle rows having clogged nozzles independently, thereby recovering the nozzles, while measures against the thickening of a liquid in nozzles can be carried out.

According to a first exemplary aspect of the invention, the above is achieved by a droplet discharge device to discharge a droplet to a workpiece, including: a head including a plurality of nozzle rows that have a plurality of nozzles on a nozzle surface in order to discharge the droplet of a supplied liquid; a non-discharge nozzle detector detecting a nozzle row of the plurality of nozzle rows having a clogged nozzle as a non-discharge nozzle; a suction device to seal the nozzle row including the non-discharge nozzle that is detected on the nozzle surface and performing suction on the nozzle row to eliminate clogging of the non-discharge nozzle; and a moisture retaining device to seal the plurality of nozzle rows on the nozzle surface to retain moisture of the nozzle surface.

In the structure of the first exemplary aspect, the head includes a plurality of nozzle rows that have a plurality of nozzles on a nozzle surface in order to discharge droplets of a supplied liquid.

The non-discharge nozzle detector detects which nozzle in the plural nozzle rows is clogged so as to be a non-discharge nozzle.

The suction device seals nozzle rows including non-discharge nozzles on the nozzle surface and performing suction thereon so as to eliminate the clogging of the non-discharge nozzles.

The moisture retaining device seals the plurality of nozzle rows on the nozzle surface to retain the moisture of the nozzle surface.

Thus, for a head having a plurality of nozzle rows, nozzle rows having clogged nozzles are detected in advance and suction is performed on the nozzle rows having the clogged nozzles independently, thereby recovering the nozzles, while measures against the thickening of a liquid in the recovered nozzles can be carried out. Therefore, the consumption amount of a liquid wasted to eliminate the clogging of nozzles can be reduced while the device can be miniaturized.

According to a second exemplary aspect of the invention, the structure of the first exemplary aspect further includes an operation unit moving the head relative to the suction device so as to align the nozzle row including the non-discharge nozzle with the suction device, and moving the head relative to the moisture retaining device so as to align the plurality of nozzle rows with the moisture retaining device.

In the structure of the second exemplary aspect, the operation unit moves the head relative to the suction device to align the nozzle rows including non-discharge nozzles with the suction device, and moves the head relative to the moisture retaining device to align the plural nozzle rows with the moisture retaining device.

Thus, the relative movements between the head and suction device and between the head and moisture retaining device allow sure alignment between the head and suction device and between the head and moisture retaining device.

According to a third exemplary aspect of the invention, the suction device is located near a position of the workpiece in the structure of the first exemplary aspect.

In the structure of the third exemplary aspect, the suction device is located near the position of the workpiece.

Thus, when nozzle rows having clogged non-discharge nozzles are caused in a head, suction can be performed on the nozzle rows with the suction device near the workpiece to eliminate the clogging. Therefore, suction can be performed on the clogged nozzle rows near a workpiece and hence the movement amount of a head can be reduced. In addition, since the suction device is located near a workpiece, the droplet discharge device can be miniaturized.

According to a fourth exemplary aspect of the invention, the suction device includes: a first suction cap to perform suction on one nozzle row including the non-discharge nozzle; and a second suction cap to perform suction simultaneously from a plurality of the nozzle rows including the non-discharge nozzle, in the structure of any of first through third exemplary aspects.

In the structure of the fourth exemplary aspect, the suction device has the first and second suction caps. The first suction cap performs suction on one nozzle row including non-discharge nozzles. The second suction cap can perform suction simultaneously from plural nozzle rows including non-discharge nozzles.

Thus, the first or second suction cap is selected corresponding to either the case in which the number of nozzle rows including non-discharge nozzles is one, or the case in which that is two or more. Thereby suction is taken from nozzle rows efficiently to eliminate the clogging of nozzles.

According to a fifth exemplary aspect of the invention, the structure of the fourth exemplary aspect further includes a wiping device to wipe only a part of the nozzle surface having the nozzle row including the non-discharge nozzle after suction by the suction device.

In the structure of the fifth exemplary aspect, the wiping device wipes only a part of the nozzle surface including nozzle rows that have non-discharge nozzles after suction by the suction device.

Thus, the wiping device does not wipe the whole surface of a nozzle surface but wipes a part of the nozzle surface after the suction device takes suction from clogged nozzle rows, reducing or preventing the wear of the nozzle surface.

According to a sixth exemplary aspect of the invention, the droplet is discharged into the moisture retaining device and microvibration is applied to a liquid boundary in the nozzle by a driving element to discharge a droplet provided for the nozzle, in order to reduce or prevent thickening of the liquid in the nozzle that is not clogged and is normal in the nozzle row and reduce or prevent thickening of the liquid in the nozzle from which clogging has been eliminated in the nozzle row, in the structure of the fourth exemplary aspect.

In the structure of the sixth exemplary aspect, the droplets are discharged into the moisture retaining device and microvibration is applied to liquid boundaries in the nozzles by driving elements to discharge droplets provided for respective nozzles, in order to reduce or prevent the thickening of a liquid in the nozzles that are not clogged and are normal in the nozzle rows and to reduce or prevent the thickening of a liquid in the nozzles from which clogging is eliminated in the nozzle rows.

Thus, the thickening of a liquid in nozzles can be reduced or prevented and therefore the clogging of the nozzles can be reduced or prevented by discharging droplets and applying microvibration to the liquid boundaries for the liquid in each nozzle.

According to a seventh exemplary aspect of the invention, an amount of suction from the nozzle surface by the suction device is increased depending on pause time of the head immediately until operation of discharging the droplet to the workpiece, in the structure of the seventh exemplary aspect.

In the structure of the seventh exemplary aspect, the amount of suction from the nozzle surface by the suction means is increased depending on pause time of the head immediately until the operation of discharging the droplet to the workpiece.

Thus, the longer the pause time of a head is, the more the suction amount from a nozzle surface is increased. Thereby, recovery treatment for clogged non-discharge nozzles can be carried out.

According to an eighth exemplary aspect of the invention, an amount of suction from the nozzle surface by the suction device is increased if a rate of the non-discharge nozzle in the nozzle row is above a predetermined certain value, in the structure of the eighth exemplary aspect.

In the structure of the eighth exemplary aspect, the amount of suction from the nozzle surface by the suction device is increased if the rate of the non-discharge nozzles in the nozzle row is above a predetermined certain value.

Thus, if the rate of non-discharge nozzles in a nozzle row is above a certain value, the suction amount from a nozzle surface is increased. Thereby, recovery treatment for the clogged non-discharge nozzles can be carried out more surely.

According to a ninth exemplary aspect of the invention, the above is achieved by a device to maintain discharge performance of a head with a nozzle surface. The device includes a droplet discharge device to discharge a droplet from the head to a workpiece. The device includes: a non-discharge nozzle detector detecting a nozzle row in the head having a clogged nozzle as a non-discharge nozzle, the head including a plurality of nozzle rows that have a plurality of nozzles on the nozzle surface in order to discharge the droplet of a supplied liquid; a suction device to seal the nozzle row including the non-discharge nozzle on the nozzle surface and performing suction on the nozzle row to eliminate clogging of the non-discharge nozzle; and a moisture retaining device to seal the plurality of nozzle rows on the nozzle surface to retain moisture of the nozzle surface.

Thus, for a head having a plurality of nozzle rows, nozzle rows having clogged nozzles are detected in advance and suction is performed on the nozzle rows having the clogged nozzles independently, thereby recovering the nozzles, while measures against the thickening of a liquid in the nozzles can be carried out. Therefore, the consumption amount of a liquid wasted to eliminate the clogging of nozzles can be reduced while the device can be miniaturized.

According to a tenth exemplary aspect of the invention, the above aim is achieved by a method to maintain discharge performance of a head with a nozzle surface in a droplet discharge device to discharge a droplet from the head to a workpiece. The method includes: detecting, by a non-discharge nozzle detector, a nozzle row in the head having a clogged nozzle as a non-discharge nozzle, the head including a plurality of nozzle rows that have a plurality of nozzles on the nozzle surface in order to discharge the droplet of a supplied liquid; sealing, by a suction device, the nozzle row including the non-discharge nozzle on the nozzle surface and performing suction on the nozzle row to eliminate clogging of the non-discharge nozzle; and sealing, by a moisture retaining device, the plurality of nozzle rows on the nozzle surface to retain moisture of the nozzle surface.

Thus, for a head having a plurality of nozzle rows, nozzle rows having clogged nozzles are detected in advance and suction is performed on the nozzle rows having the clogged nozzles independently, thereby recovering the nozzles, while measures against the thickening of a liquid in the nozzles can be carried out. Therefore, the consumption amount of a liquid wasted to eliminate the clogging of nozzles can be reduced while the device can be miniaturized.

According to an eleventh exemplary aspect of the invention, the above aim is achieved by a method to manufacture an electro-optical device, using a droplet discharge device to discharge a droplet from a head to a workpiece to manufacture an electro-optical device. The method includes: detecting, by a non-discharge nozzle detector, a nozzle row in the head having a clogged nozzle as a non-discharge nozzle, the head including a plurality of nozzle rows that have a plurality of nozzles on a nozzle surface in order to discharge the droplet of a supplied liquid; sealing, by a suction device, the nozzle row including the non-discharge nozzle on the nozzle surface and performing suction on the nozzle row to eliminate clogging of the non-discharge nozzle; sealing, by a moisture retaining device, the plurality of nozzle rows on the nozzle surface to retain moisture of the nozzle surface; and discharging the droplet to the workpiece to manufacture an electro-optical device.

Thus, for a head having a plurality of nozzle rows, nozzle rows having clogged nozzles are detected in advance and suction is performed on the nozzle rows having the clogged nozzles independently, thereby recovering the nozzles, while measures against the thickening of a liquid in the nozzles that are not clogged can be carried out. Therefore, the consumption amount of a liquid wasted to eliminate the clogging of nozzles can be reduced while the device can be miniaturized.

According to a twelfth exemplary aspect of the invention, the above is achieved by an electro-optical device manufactured by using a droplet discharge device to discharge a droplet from a head to a workpiece, and manufactured by a method. The method includes: detecting, by a non-discharge nozzle detector, a nozzle row in the head having a clogged nozzle as a non-discharge nozzle, the head including a plurality of nozzle rows that have a plurality of nozzles on a nozzle surface in order to discharge the droplet of a supplied liquid; sealing, by a suction device, the nozzle row including the non-discharge nozzle on the nozzle surface and performing suction on the nozzle row to eliminate clogging of the non-discharge nozzle; sealing, by a moisture retaining device, the plurality of nozzle rows on the nozzle surface to retain moisture of the nozzle surface; and discharging the droplet to the workpiece.

Thus, for a head having a plurality of nozzle rows, nozzle rows having clogged nozzles are detected in advance and suction is performed on the nozzle rows having the clogged nozzles independently, thereby recovering the nozzles, while measures against the thickening of a liquid in the nozzles that are not clogged can be carried out. Therefore, the consumption amount of a liquid wasted to eliminate the clogging of nozzles can be reduced while the device can be miniaturized.

According to a thirteenth exemplary aspect of the invention, an electronic apparatus includes the electro-optical device of the twelfth exemplary aspect.

BRIEF DESCRIPTION OF THE DRAWINGS

FIG. 13 is a table showing an example of total suction amounts in suction operation;

DETAILED DESCRIPTION OF EXEMPLARY EMBODIMENTS

Exemplary embodiments of the present invention will now be described below with reference to the drawings.

Figure 1:
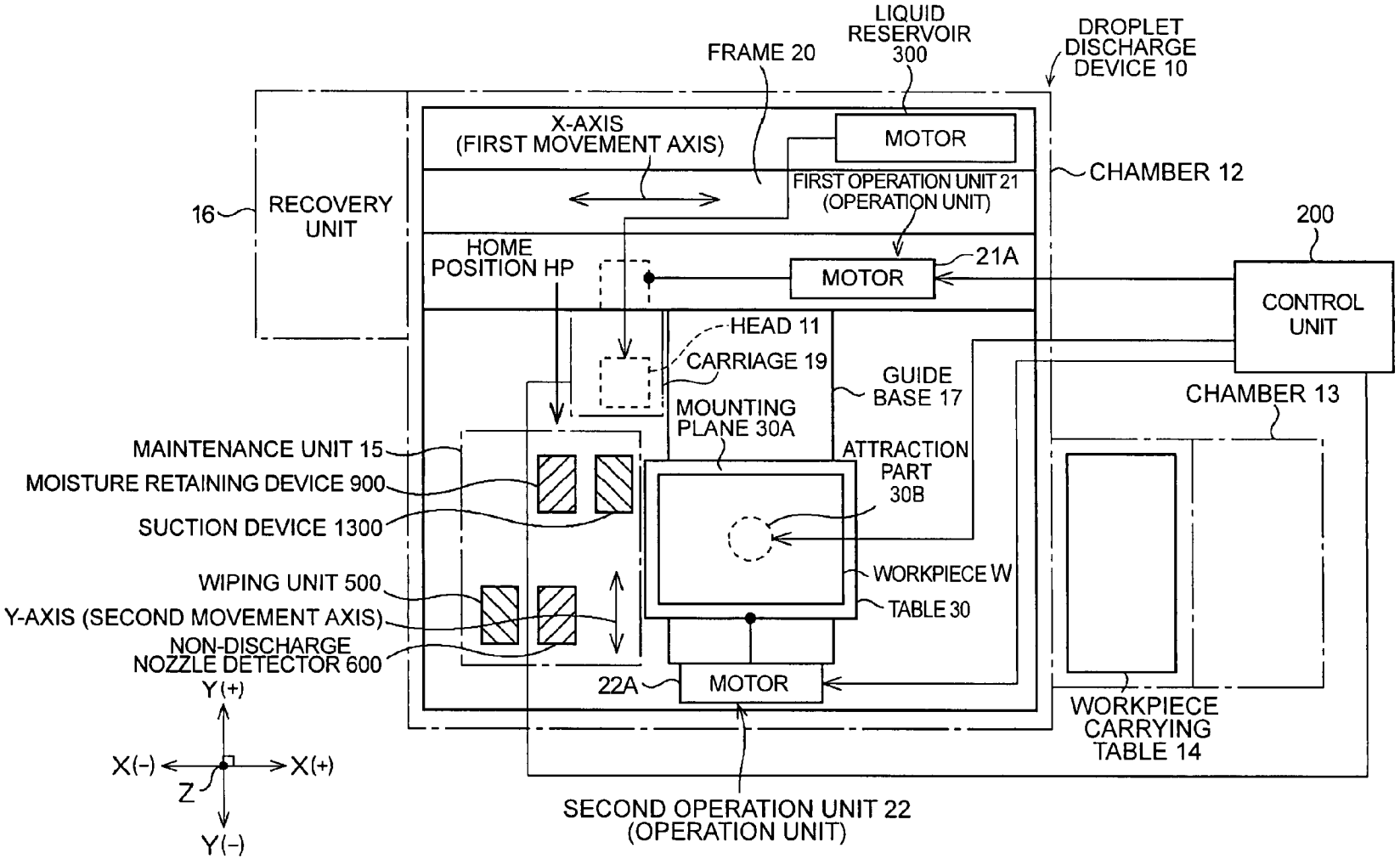
FIG. 1 is a schematic showing an exemplary embodiment of a droplet discharge device of an exemplary aspect of the present invention.

FIG. 1 is a schematic showing an exemplary embodiment of a droplet discharge device of the present invention. A droplet discharge device 10 shown in FIG. 1 can be used as a drawing system, for example. The drawing system is incorporated into a manufacturing line of an organic electro luminescence (EL) device, for example, which is one type of so-called flat panel displays. The droplet discharge device 10 can form light-emitting elements to serve as pixels of an organic EL device.

The droplet discharge device 10 can be used as an ink jet drawing device, for example. The droplet discharge device 10 forms, for example, light-emitting elements of an organic EL device by a droplet discharge method (ink jet method). A head (also referred to as a functional liquid discharge head) in the droplet discharge device 10 forms light-emitting elements of an organic EL element. Specifically, in a manufacturing step of an organic EL element, after a bank forming step and plasma treatment step, a head into which a light-emitting functional material is introduced is scanned relative to a substrate (one example of workpieces) having banks thereon. Thereby, the droplet discharge device 10 can form film parts of hole injection/transport layers and light-emitting layers corresponding to the positions of pixel electrodes of the substrate.

By using two droplet discharge devices 10, for example, hole injection/transport layers can be used by one droplet discharge device 10, while light-emitting layers of three colors of red (R), green (G) and blue (B) can be formed by the other droplet discharge device 10.

The droplet discharge device 10 of FIG. 1 is housed in a chamber 12. The chamber 12 has another chamber 13. The chamber 13 houses a workpiece carrying table 14. The workpiece carrying table 14 is a table to carry a workpiece W into the chamber 12 and carry the treated workpiece W out from a table 30.

A maintenance unit 15 to carry out the maintenance of a head 11 is housed in the chamber 12 shown in FIG. 1. The chamber 12 has a recovery unit 16 outside thereof.

The maintenance unit 15 includes a suction device 1300, a wiping unit 500, a non-discharge nozzle detector 600, a moisture retaining device 900, a weight measuring unit (not shown), and so forth.

The suction device 1300 sucks droplets and air bubbles from the nozzle surface of the head 11 to eliminate the clogging in nozzles, so as to recover the discharge performance of the head 11. A wiping blade of the wiping unit 500 wipes contamination, such as liquids, attached to the nozzle surface. The non-discharge nozzle detector 600 checks the discharge condition of droplets discharged from the head 11. The weight measuring unit measures the weight of droplets discharged from the head 11.

The moisture retaining device 900 seals the nozzle surface of the head 11 to maintain the discharge performance of the head 11.

The recovery unit 16 has, for example, a droplets recovery system to recover droplets and a cleaning-fluid supplying system to supply a cleaning solvent used after wiping.

The air in the chambers 12 and 13 is controlled independently, and thus the variation of atmospheres in the chambers 12 and 13 is prevented. The chambers 12 and 13 are used to eliminate the influence of the atmospheric air since, for example, water or the like in the atmospheric air is undesirable in the manufacturing of organic EL elements. A dry air is continuously introduced into and exhausted from the chambers 12 and 13, thereby maintaining a dry air atmosphere in the chambers.

Constituent elements in the chamber 12 shown in FIG. 1 will now be described.

The chamber 12 houses, a frame 20, the head 11, a carriage 19, a liquid reservoir 300, a first operation unit 21, a second operation unit 22, the table 30 and a guide base 17.

The frame 20 of FIG. 1 is provided parallel to the X-axis direction. The guide base 17 is provided along the Y-axis direction. The frame 20 is above the guide base 17. The X-axis corresponds to a first movement axis, while the Y-axis corresponds to a second movement axis. The X-axis is perpendicular to the Y-axis and the Z-axis. The Z-axis is parallel to the direction normal to the drawing plane of FIG. 1.

The first operation unit 21 linearly reciprocates the carriage 19 and the head 11 along the frame 20 in the X-axis direction, and positions them.

The second operation unit 22 has the table 30. The workpiece W shown in FIG. 1 can be detachably mounted on the table 30. The table 30 of the second operation unit 22 holds the workpiece W during discharging droplets from the head 11 to the workpiece W. The second operation unit 22 linearly moves the workpiece W on the guide base 17 along the Y-axis direction, and positions it.

The first operation unit 21 has a motor 21A to linearly move the head 11 along the X-axis direction and position it. For example, a lead screw is used for the motor 21A to linearly move the head 11 along the X-axis direction. The motor 21A may be a rotating electric motor, or may be a linear motor.

A motor 22A of the second operation unit 22 linearly moves the table 30 along the guide base 17 in the Y-axis direction and positions it. For example, a rotating electric motor that rotates a lead screw can be used as the motor 22A. A linear motor also can be used as the motor 22A.

The table 30 of the second operation unit 22 has a mounting plane 30A. The mounting plane 30A is perpendicular to the Z-axis direction of FIG. 1. The mounting plane 30A has an attraction part 30B. The attraction part 30B can grip the workpiece W by vacuum attraction. Thus, the workpiece W can be fixed to the mounting plane 30A detachably without displacement. The first and second operation units 21 and 22 constitute an operation unit in the present exemplary embodiment of the present invention.

A structural example of the carriage 19 and the head 11 will now be described with reference to FIGS. 2 and 3.

Figure 2:
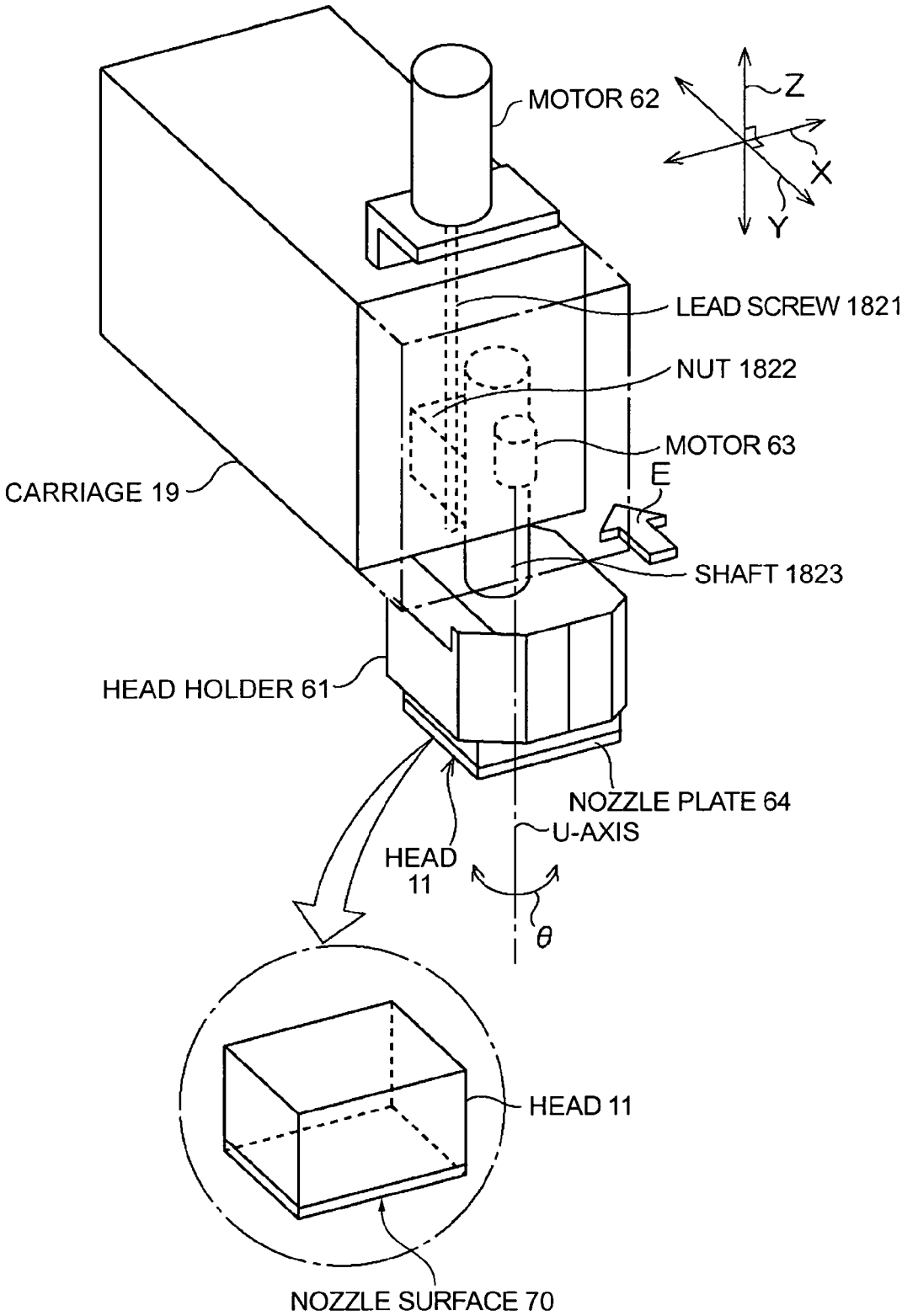
FIG. 2 is a schematic showing a carriage, a head, etc., of the droplet discharge device of FIG. 1.

FIG. 2 is a schematic showing a configuration example around the carriage 19 and the head 11. FIG. 3 is an example of a front elevation obtained by viewing FIG. 2 from direction E.

The carriage 19 can be moved along the X-axis direction and be positioned by the motor 21A shown in FIG. 1. The carriage 19 detachably holds the head 11 by using a head holder 61. An output shaft of a motor 62 is coupled to a lead screw 1821. The lead screw 1821 gears with a nut 1822 of a shaft 1823.

The operation of the motor 62 shown in FIG. 2 causes a unit of the head holder 61 and the head 11 to vertically move along the Z-axis direction and be positioned. The operation of another motor 63 allows the head 11 to rotate in direction θ around the U-axis.

Figure 3:
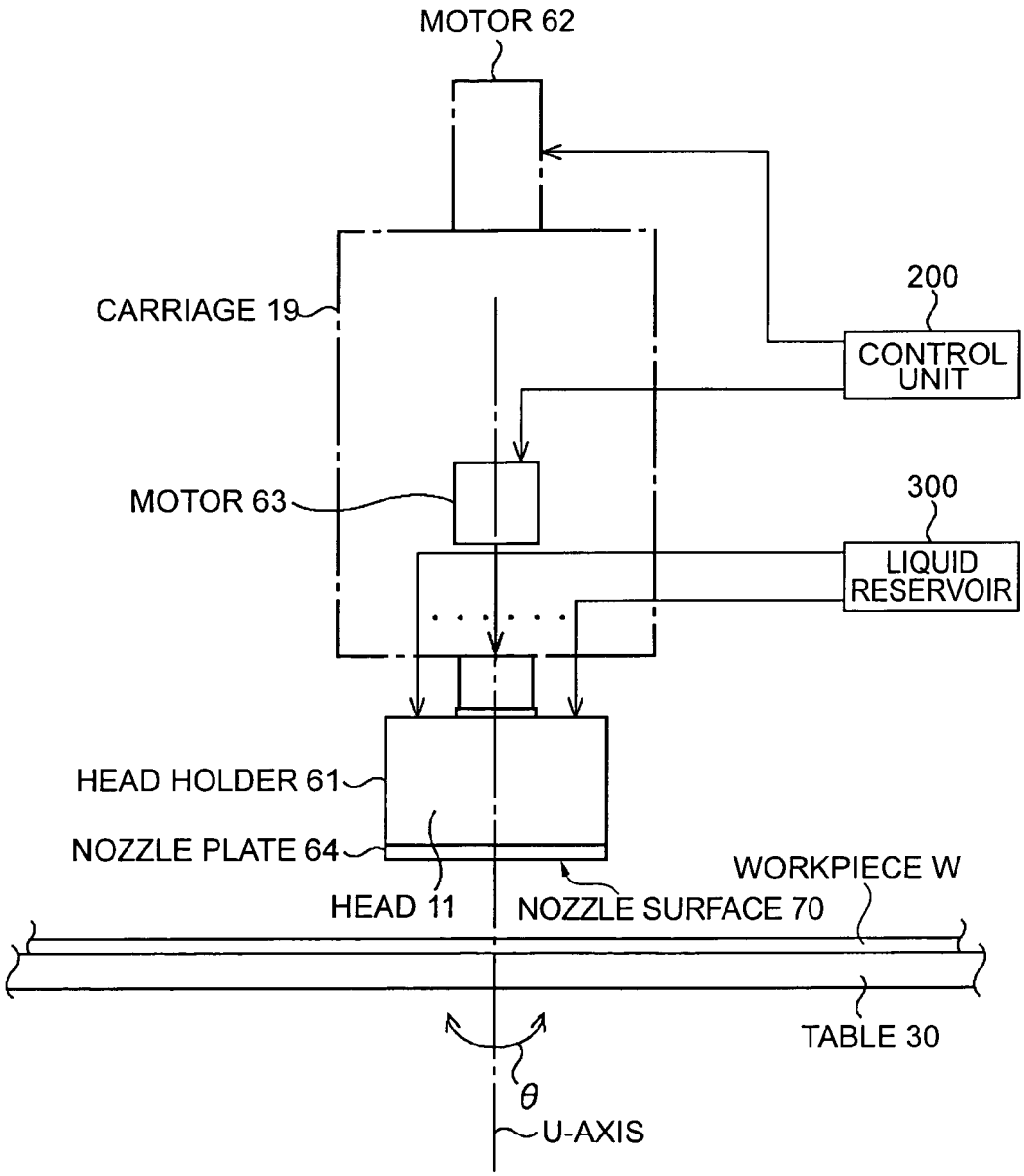
FIG. 3 is a schematic showing the carriage, the head, etc., of FIG. 2 and viewed from direction E in FIG. 2.

The head 11 has a nozzle plate 64 as shown in FIGS. 2 and 3. The lower surface of the nozzle plate 64 is a nozzle surface 70. The nozzle surface 70 has nozzle openings of plural nozzles. The head 11 is coupled to the liquid reservoir 300 via a tube. The liquid reservoir 300 reserves an ink, which is one example of a liquid. The liquid reservoir 300 is also referred to as a functional liquid reservoir. The liquid is one example of functional liquids used to form film parts of hole injection/transport layers and light-emitting layers of an organic EL element. The liquid in the liquid reservoir 300 can be discharged from nozzle openings based on an ink jet method by, for example, the operation of piezoelectric resonators. A control unit 200 controls the operation of the motors 62 and 63 as shown in FIG. 3.

Figure 4:
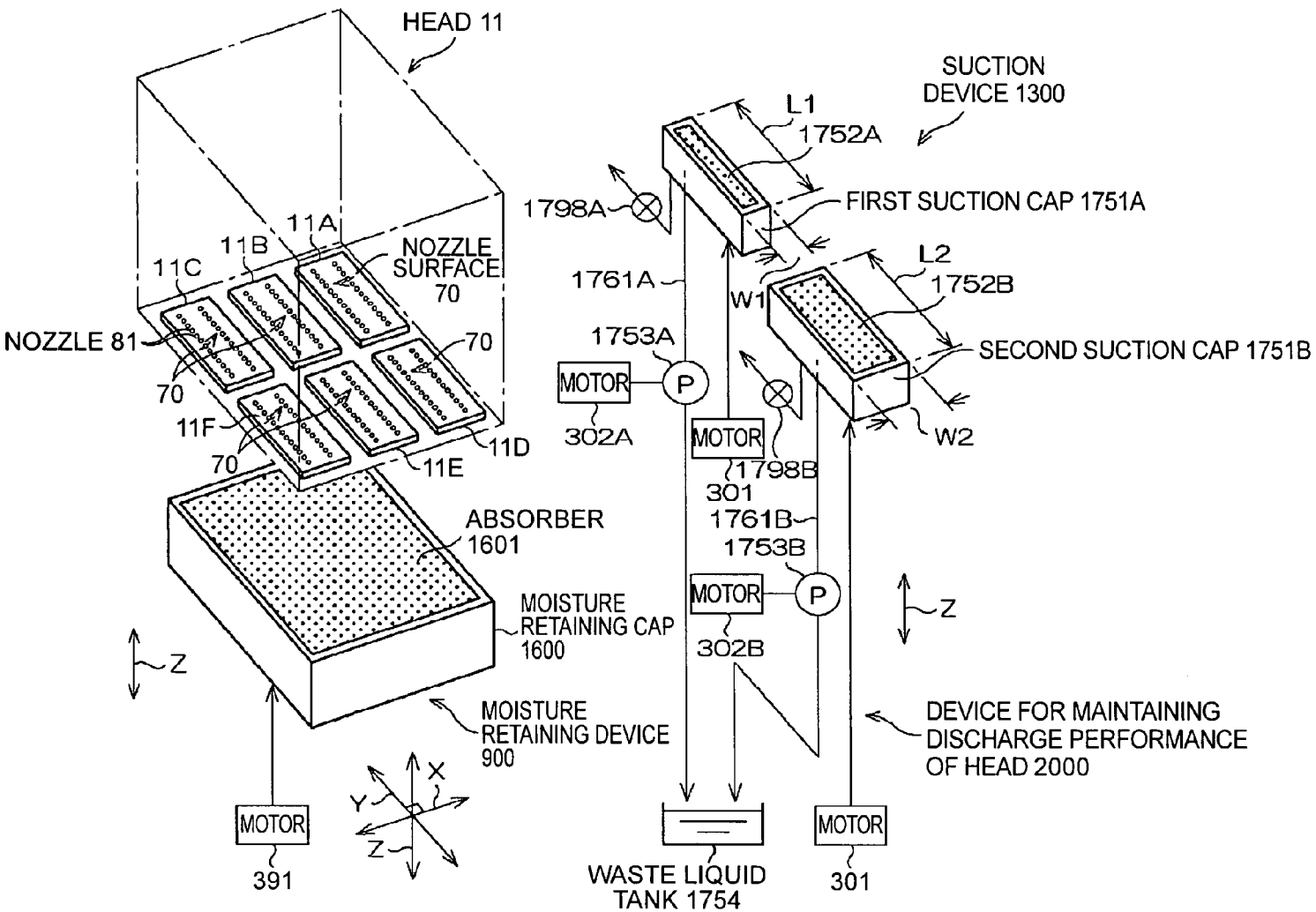
FIG. 4 is a schematic showing structural examples of a head and a device to maintain the discharge performance of a head.
Figure 5:
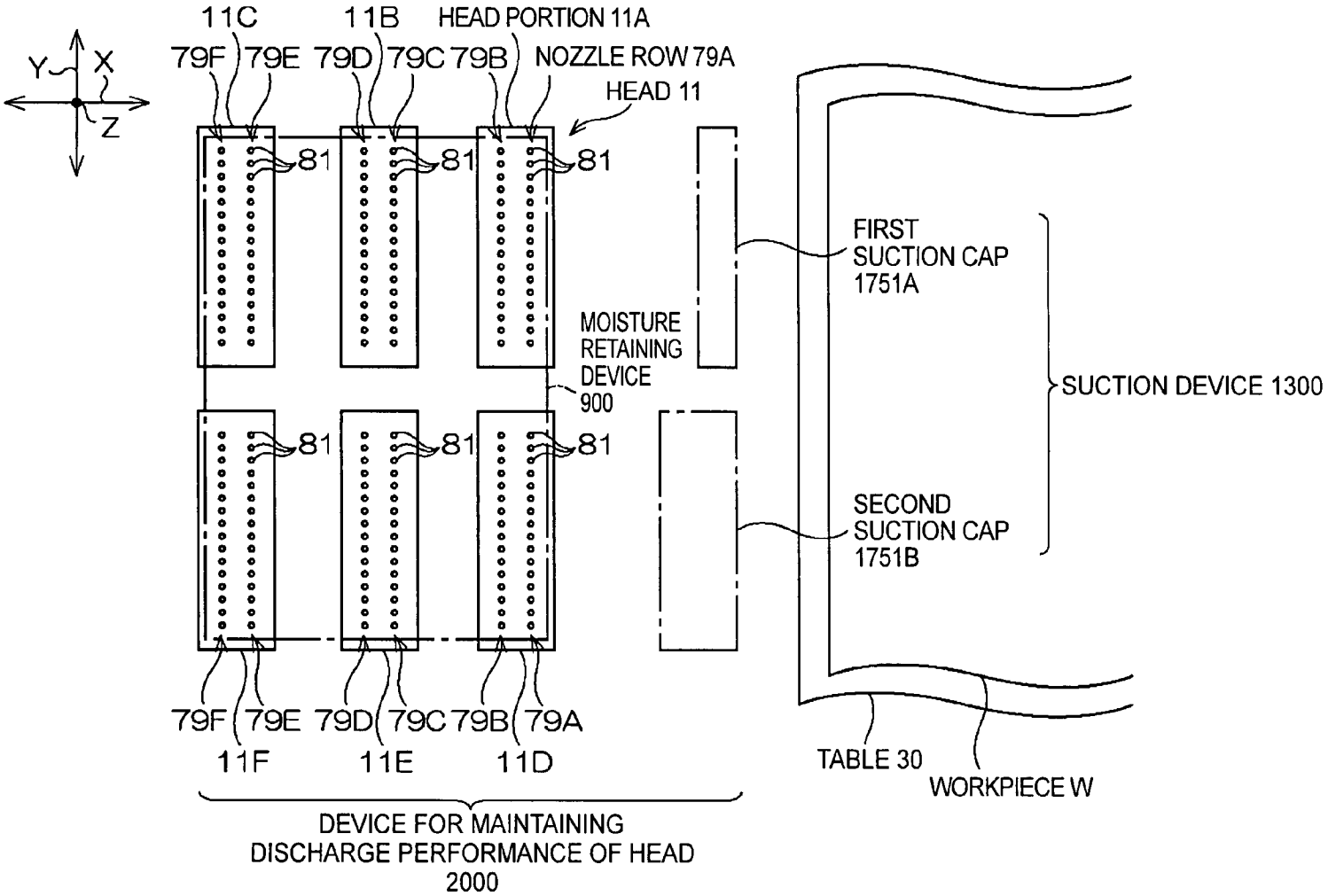
FIG. 5 is a schematic showing a head and a device to maintain the discharge performance of a head.

FIG. 4 shows a configuration example of the head 11 and a structural example of a device 2000 to maintain the discharge performance of a head. FIG. 5 is a schematic showing the structural example of the head 11 and the device 2000 to maintain the discharge performance of a head.

The structural example of the head 11 will now be described with reference to FIGS. 4 and 5.

The head 11 is a so-called multiple head having a plurality of head portions 11A through 11F as shown in FIGS. 4 and 5. The head portions 11A through 11F are arranged with intervals on the under surface of the head 11. The head portions 11A through 11C are arranged along the X-axis direction at a predetermined interval. The head portions 11D through 11F are arranged along the X-axis direction at a predetermined interval.

Each of the head portions 11A through 11F of FIG. 5 has two nozzle rows. Specifically, the head portion 11A has nozzle rows 79A and 79B, the head portion 11B has nozzle rows 79C and 79D, and the head portion 11C has nozzle rows 79E and 79F.

The head portion 11D has the nozzle rows 79A and 79B, the head portion 11E has the nozzle rows 79C and 79D, and the head portion 11F has the nozzle rows 79E and 79F.

Each of the nozzle rows 79A through 79F is formed parallel to the Y-axis direction with an interval. Each of the nozzle rows 79A through 79F has a plurality of nozzles 81. Although in the configuration example of the head 11 shown in FIGS. 4 and 5, the head 11 has six head portions 11A through 11F, the number of the head portions is not limited thereto. The head 11 may be a multiple head having two through five head portions, or seven or more head portions, of course.

Also, each head portion has two nozzle rows in the example shown. However, each head portion may have three or more nozzle rows.

Nozzle rows in each of the head portions 11A through 11F are coupled to the liquid reservoir 300 shown in FIG. 1. Each nozzle row may discharge respective liquids of different kinds contained in the liquid reservoir 300. Otherwise, for example, adjacent nozzle rows may discharge the same liquid.

The device 2000 to maintain the discharge performance of a head shown in FIGS. 4 and 5 will now be described.

The device 2000 to maintain the discharge performance of a head is a device to recover and maintain the discharge performance of nozzles in nozzle rows of the head 11, and has the suction device 1300 and the moisture retaining device 900.

The suction device 1300 and the moisture retaining device 900 shown in FIGS. 4 and 5 are disposed inside the maintenance unit 15 as shown in FIG. 1. In the exemplary embodiment of FIG. 1, the suction device 1300 may be located near the table 30 so as to be close to the workpiece W. The moisture retaining device 900 is provided beside the suction device 1300.

The nozzle rows 79A through 79F in the head portions of the head 11 shown in FIG. 5 can adequately discharge liquids supplied from the liquid reservoir 300 shown in FIG. 1, to the workpiece W of FIG. 1.

The suction device 1300 takes suction only from, of nozzle rows of the head 11, nozzle rows including clogged nozzles so as to eliminate the clogging of the nozzles. The suction device 1300 has a first suction cap 1751A and a second suction cap 1751B.

The first suction cap 1751A seals only one nozzle row of the head 11 shown in FIGS. 4 and 5 and takes suction therefrom, thereby taking suction from clogged non-discharge nozzles in the one nozzle row so as to recover the nozzles.

The second suction cap 1751B seals adjacent nozzles and takes suction therefrom so as to take suction from clogged non-discharge nozzles in the adjacent nozzle rows and recover the nozzles.

Thus, the width W1 of the first suction cap 1751A, shown in FIG. 4, is set smaller than the width W2 of the second suction cap 1751B. The length L1 of the first suction cap 1751A is the same as the length L2 of the second suction cap 1751B. The lengths L1 and L2 are a bit larger than the length of the nozzle rows along the Y-axis direction.

As shown in FIG. 4, the first and second suction caps 1751A and 1751B have a box-shape, and the upper parts thereof are an opening. An absorber 1752A is housed in the first suction cap 1751A. Similarly, an absorber 1752B is housed in the second suction cap 1751B. The absorbers 1752A and 1752B are made of a porous material, such as a non-woven fabric or a porous resin in order to, for example, absorb liquids and send them to a waste liquid tank 1754 without being clogged.

The first suction cap 1751A, shown in FIG. 4, is coupled to a suction pump 1753A via a suction tube 1761A. The second suction cap 1751B is coupled to a suction pump 1753B via a suction tube 1761B. The driving of the suction pumps 1753A and 1753B by motors 302A and 302B can cause a negative pressure in the first and second suction caps 1751A and 1751B.

Thus, liquids sucked into the first and second suction caps 1751A and 1751B can be ejected via the pumps to the waste liquid tank 1754.

The first suction cap 1751A is coupled to an open air valve 1798A. The second suction cap 1751B is coupled to an open air valve 1798B.

The moisture retaining device 900 shown in FIG. 4 has a moisture retaining cap 1600. The moisture retaining cap 1600 has a box-shape, and the upper part thereof is an opening. An absorber 1601 is housed in the moisture retaining cap 1600. The absorber 1601 may be made of the same material as that of the absorbers 1752A and 1752B. The moisture retaining cap 1600 has such a size as to cover all nozzle rows 11A through 11F in the head portions of the head 11 simultaneously as shown in FIG. 4, for example. The moisture retaining cap 1600 can vertically be moved along the Z-axis direction by a motor 391.

The first and second suction caps 1751A and 1751B, shown in FIG. 4, can vertically be moved along the Z-axis direction by a motor 301, independently of each other.

Thus, the upper end of the first suction cap 1751A is closely contacted with the nozzle surface 70 of a nozzle portion of the head 11 to seal any one nozzle row, enabling suction only from one nozzle row. Similarly, the second suction cap 1751B is closely contacted with the nozzle surface 70 of a nozzle portion of the head 11 to seal any two nozzle rows, enabling suction only from two nozzle rows.

Also, the upper end of the moisture retaining cap 1600 of the moisture retaining means 900 is closely contacted with all nozzle rows to seal them. Thereby the moisture condition of all nozzle rows can be maintained.

As described above, the suction device 1300 and the moisture retaining device 900 reduce or prevent the clogging of nozzles of a head so as to maintain the discharge performance of a head.

Figure 6:
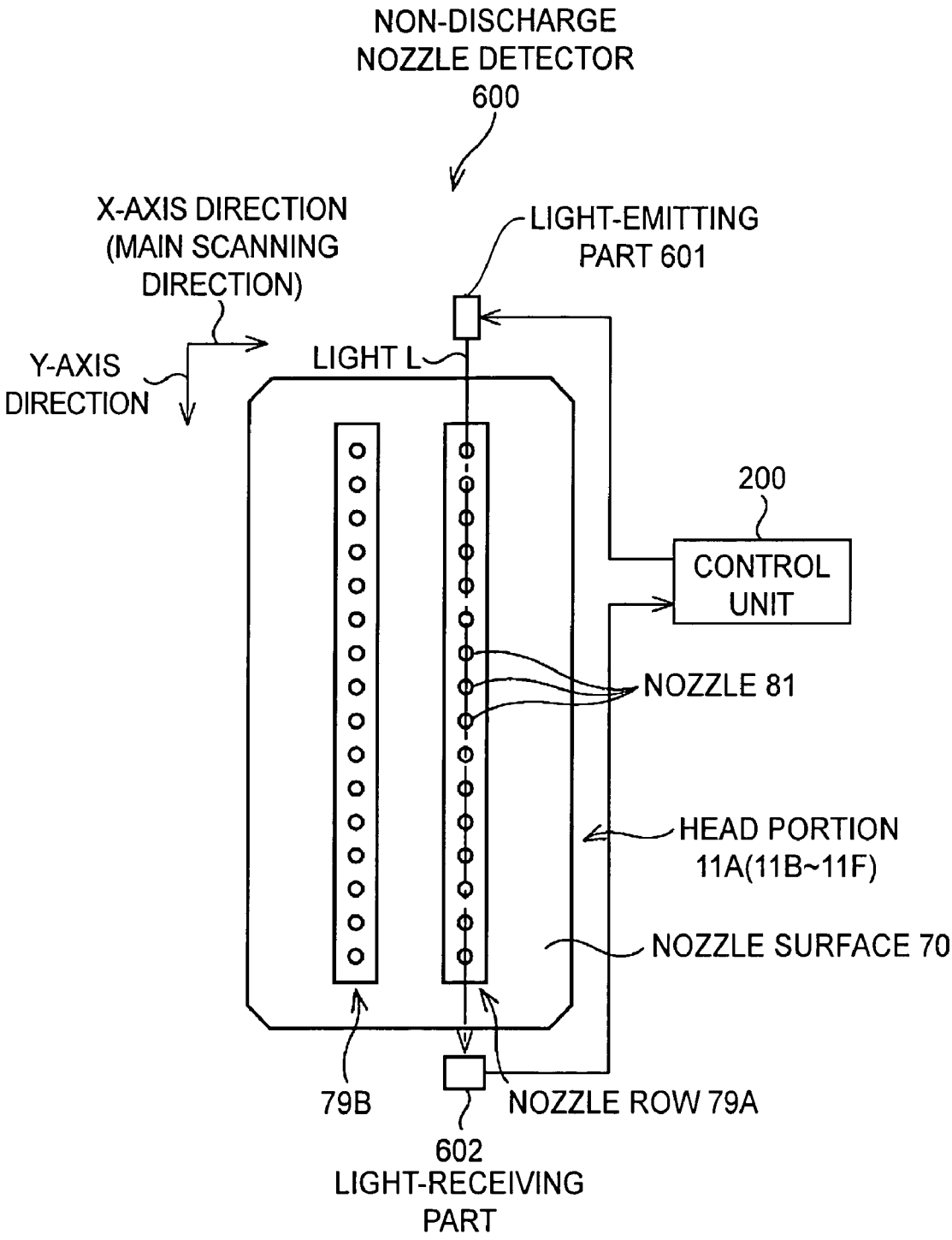
FIG. 6 is a schematic showing an example of a non-discharge nozzle detector.

FIG. 6 shows the non-discharge nozzle detector 600 and one head portion by way of example. As shown in FIG. 6, the non-discharge nozzle detector 600 is provided in order to detect clogged non-discharge nozzles of the nozzles 81 and the position of the nozzle row including the non-discharge nozzles. The non-discharge nozzle detector 600 may also be referred to as a non-operating nozzle detector or no-discharge nozzle detector. The non-discharge nozzle is a nozzle that can not discharge droplets normally because of clogging.

The non-discharge nozzle detector 600 has a light-emitting part 601 and a light-receiving part 602. The light-emitting part 601 may be a laser light-emitting part, for example. Light L from the light-emitting part 601 is received by the light-receiving part 602. When droplets are discharged from the nozzles 81, the droplets interrupt the optical path of the light L. In this case, the reception of the light L by the light-receiving part 602 is temporarily interrupted. If droplets are normally discharged from the nozzle 81, the light L to the receiving part 600 is temporarily interrupted, causing the control unit 200 to determine that the nozzle is not clogged.

In contrast, if the light L is not interrupted at all during a driving period of the nozzle 81, the control unit 200 determines that the nozzle 81 is clogged. Note that since one droplet is sometimes not enough to sufficiently detect whether the light L is interrupted or not, several droplets are desirably discharged from one nozzle 81.

After the completion of checking the clogging of each nozzle 81 of the nozzle row 79A in FIG. 6, the head 11 moves a little along the X-axis direction. Thereby the presence of non-discharge nozzles can be checked for the nozzles 81 of the next nozzle row 79B. In this manner, the non-discharge nozzle detector 600 sequentially detects the presence of non-discharge nozzles in a contactless manner for the nozzle rows 79A through 79F in the nozzle portions 11A through 11F shown in FIG. 5, so as to send the detection result to the control unit 200 shown in FIG. 1.

As described above, the non-discharge nozzle detector 600 detects flying droplets and thereby can check the presence of clogging (that is, the presence of dot missing) of nozzles 81 of the nozzle rows 79A through 79F.

An example of electrical coupling among constituent elements of the droplet discharge device of an exemplary aspect of the present invention will now be described with reference to FIG. 7.

Figure 7:
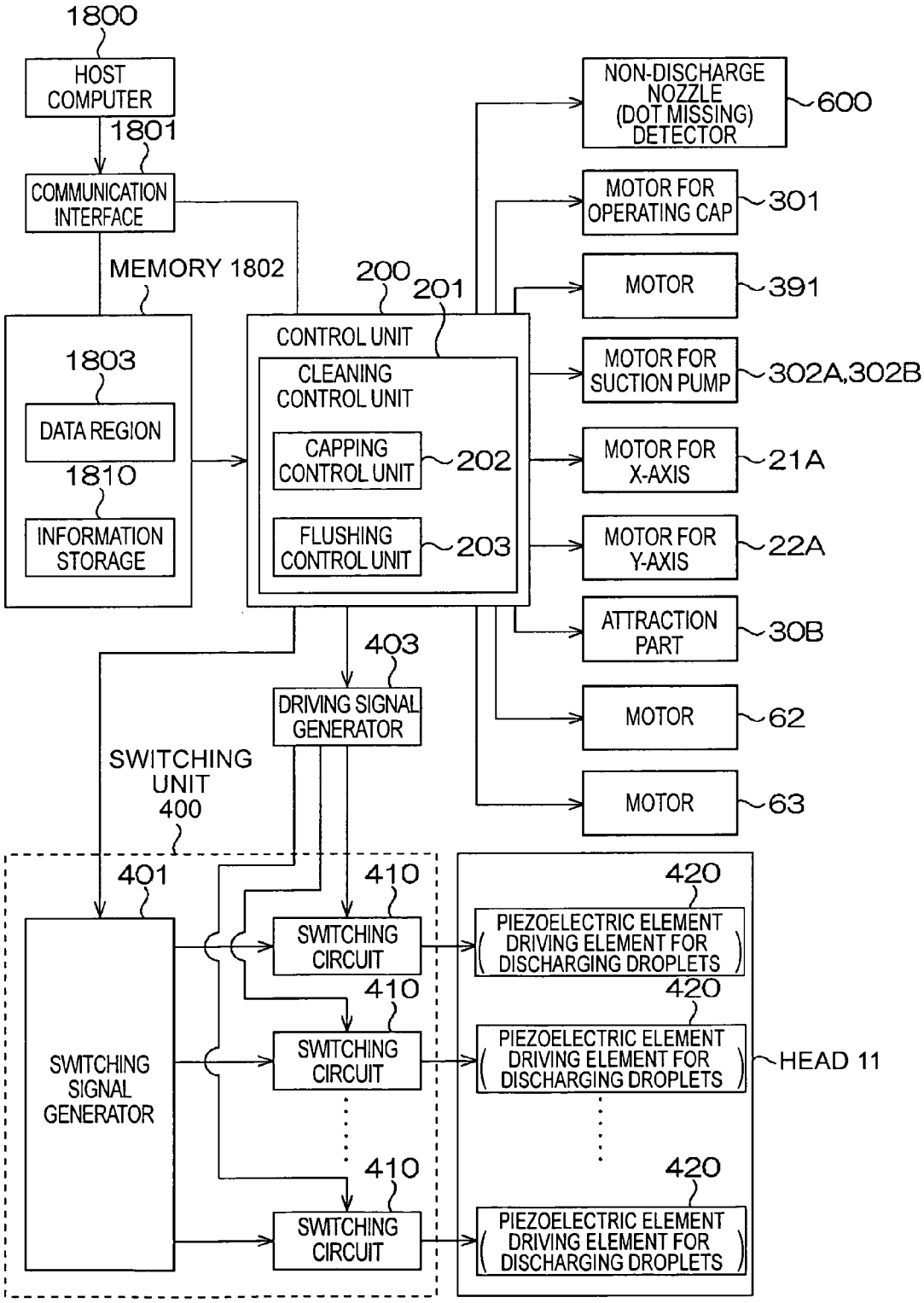
FIG. 7 is a schematic showing an example of electrical coupling among a control unit and peripheral elements.

The control unit 200 shown in FIG. 7 is coupled to a host computer 1800 via a communication interface 1801. The communication interface 1801 is coupled to a memory 1802. The memory 1802 has a data region 1803 and an information storage 1810.

The control unit 200 has a cleaning control unit 201. The cleaning control unit 201 has a capping control unit 202 and a flushing control unit 203.

The control unit 200 is electrically coupled to the non-discharge nozzle detector 600, the motor 301 to operate a cap, the motor 391, the motors 302A and 302B for suction pumps, the motor 21A for the X-axis, the motor 22A for the Y-axis, the attraction part 30B, the motors 62 and 63, a switching signal generator 401 in a switching unit 400, and a driving signal generator 403.

The motors 21A and 22A, the attraction part 30B, and the motors 62 and 63 in FIG. 7 are also shown in FIG. 1 or FIG. 2. In response to signals from the control unit 200, the driving signal generator 403 shown in FIG. 7 adequately supplies signals to a plurality of switching circuits 410 in the switching unit 400. Each switching circuit 410 is coupled to respective piezoelectric elements (also referred to as piezoelectric resonators) 420. The switching signal generator 401 controls the switching circuits 410 in accordance with signals applied from the control unit 200 so as to supply driving signals to the required piezoelectric elements 420. The piezoelectric elements 420 are driving elements to discharge droplets that discharge a liquid from nozzles and apply microvibration to a liquid boundary in nozzles.

The head 11 includes the piezoelectric elements 420 that are each provided corresponding to respective nozzles 81 of each nozzle row shown in FIG. 4. The driving of the piezoelectric element 420 leads to the expansion and contraction thereof, which allows droplets to be discharged from the nozzle 81.

The motor 301 to operate a cap and the motors 302A and 302B for suction pumps in FIG. 7 are also shown in FIG. 4.

Figure 8:
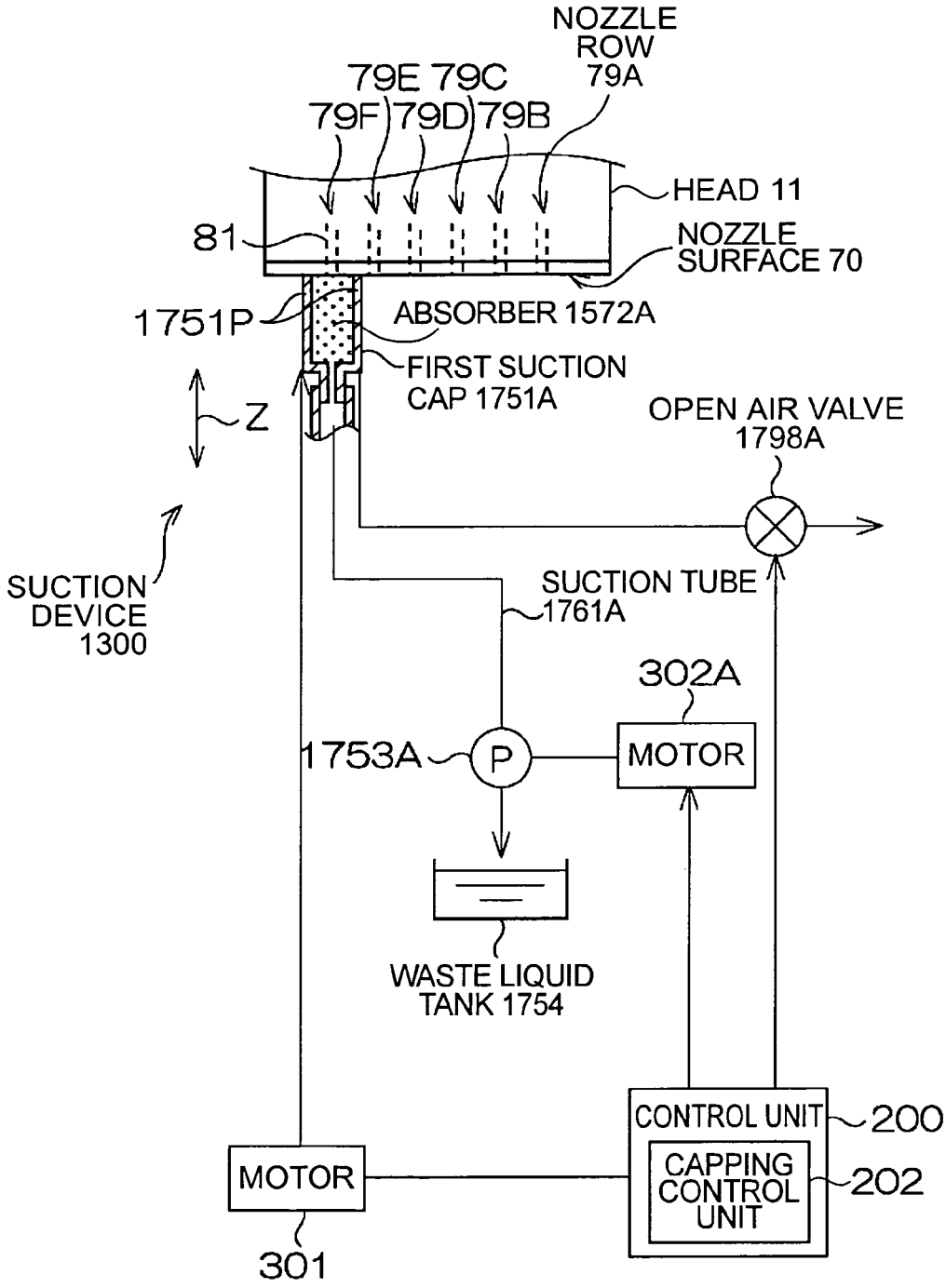
FIG. 8 is a schematic showing a first suction cap to seal only one nozzle row and the periphery thereof.

FIG. 8 shows the nozzle surface 70 of the head 11, the first suction cap 1751A of the suction device 1300, and the peripheral units.

Figure 9:
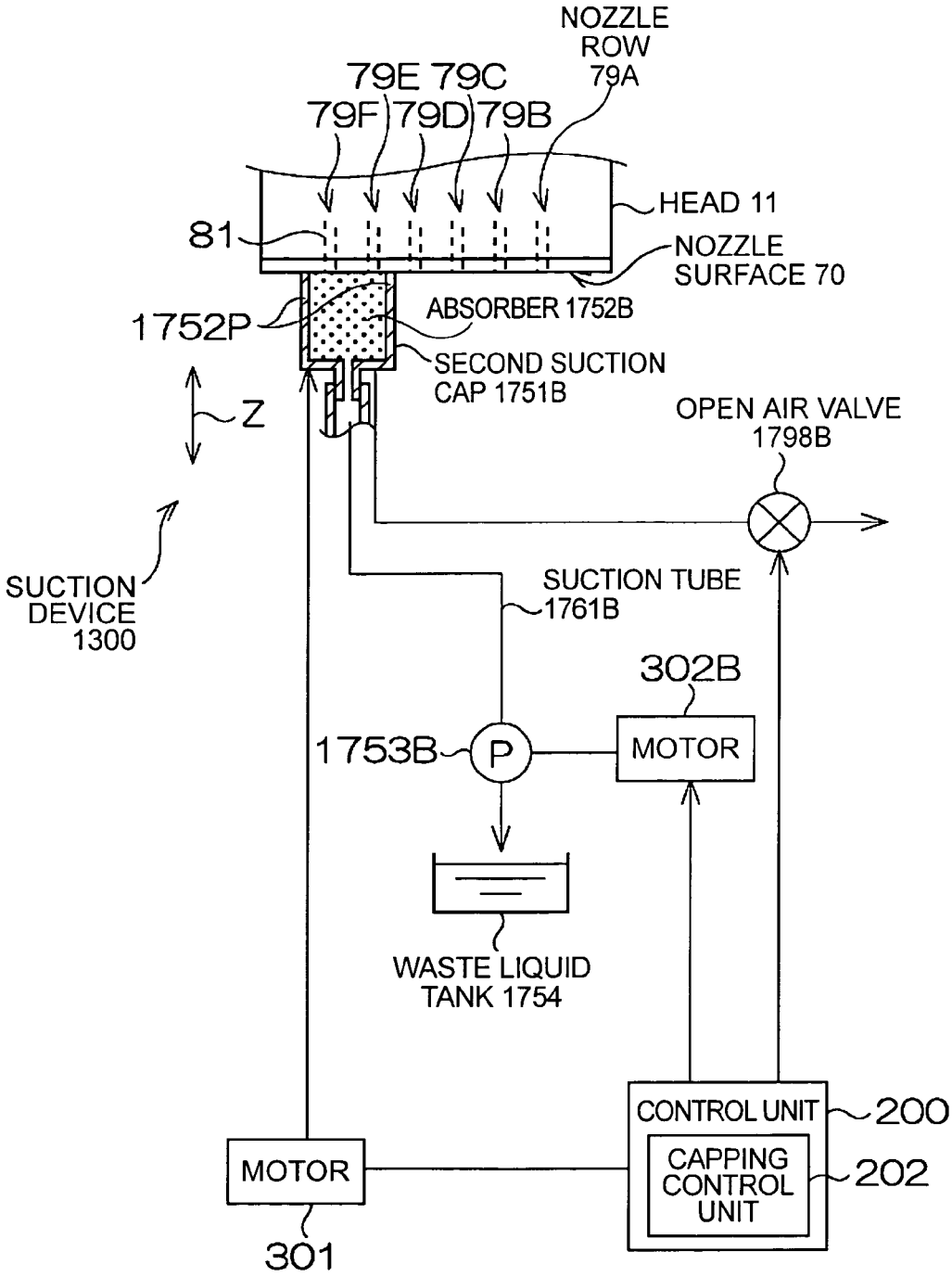
FIG. 9 is a schematic showing a second suction cap to seal only two nozzle rows and the periphery thereof.

FIG. 9 shows the nozzle surface 70 of the head 11, the second suction cap 1751B of the suction device 1300, and the peripheral units.

As shown in FIG. 8, an upper end 1751P of the first suction cap 1751A seals only one nozzle row on the nozzle surface 70, for example, only the nozzle row 79F. The motor 301 vertically moves the first suction cap 1751A along the Z-axis direction, thereby causing the first suction cap 1751A to be closely contacted with the nozzle surface 70 or be moved away from the nozzle surface 70. The motors 301 and 302A, and the open air valve 1798A can be controlled by the capping control unit 202 of the control unit 200.

Similarly, as shown in FIG. 9, the second suction cap 1751B seals only two nozzle rows in selected one head portion on the nozzle surface 70, for example, only the nozzle rows 79E and 79F. For this purpose, the second suction cap 175 1B has an upper end 1752P. The operation of the motor 301 enables the second suction cap 1751B to seal the nozzle surface 70 or be moved away from the nozzle surface 70. The motors 301 and 302B, and the open air valve 1798B can be controlled by the capping control unit 202 of the control unit 200.

Figures 10A, 10B, 10C, 10D:
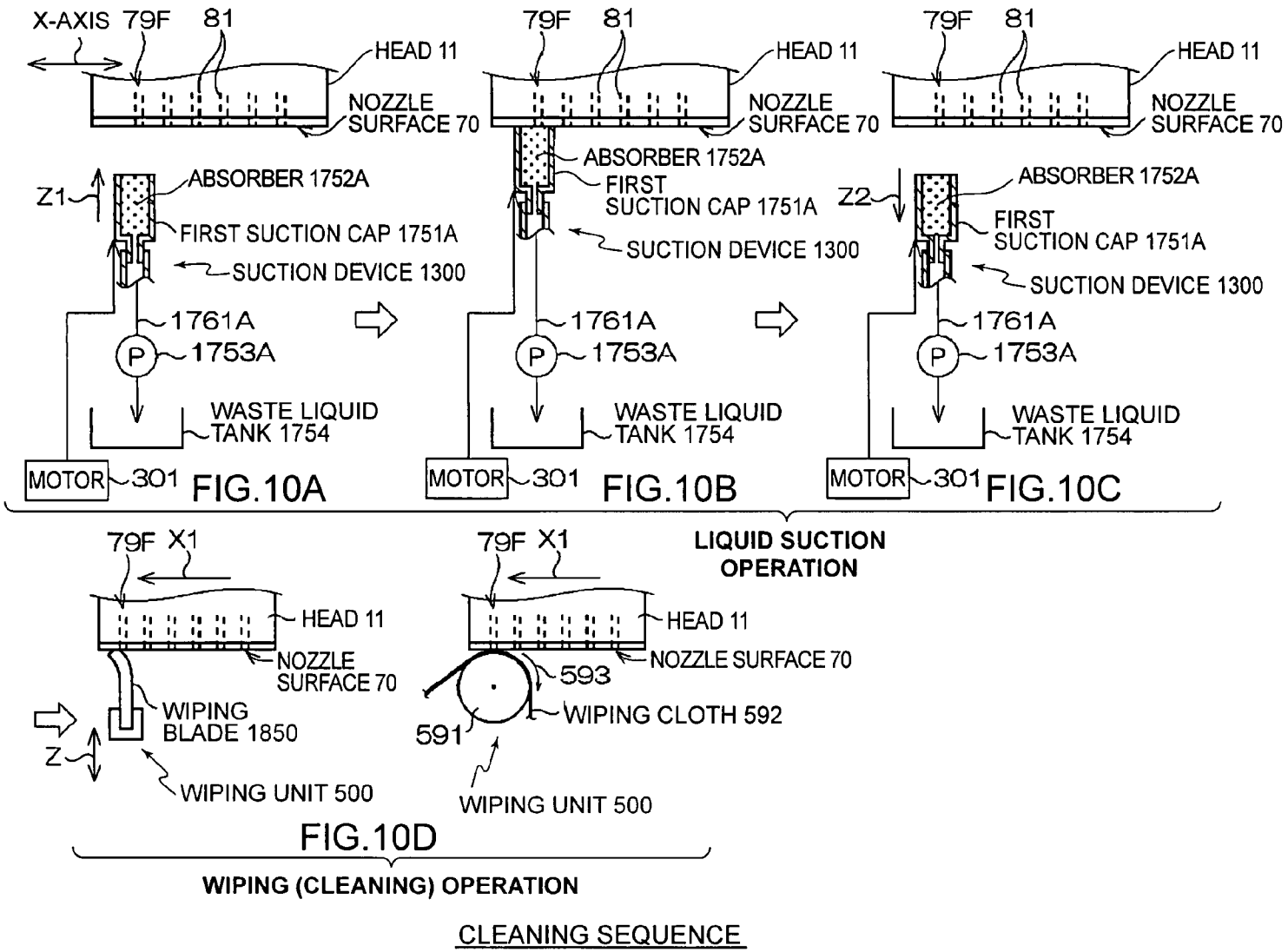
FIGS. 10A through 10D are schematics showing a way of sealing one nozzle row and then carrying out wiping.

FIGS. 10A through 10C show the operation sequence of suction only from one nozzle row 79F on the nozzle surface 70 of the head 11 by the first suction cap 1751A shown in FIG. 8. FIG. 10D shows an example of a wiping operation with a wiping blade 1850 for a part of the nozzle surface 70 corresponding to the nozzle row 79F.

Figures 11A, 11B, 11C, 11D:
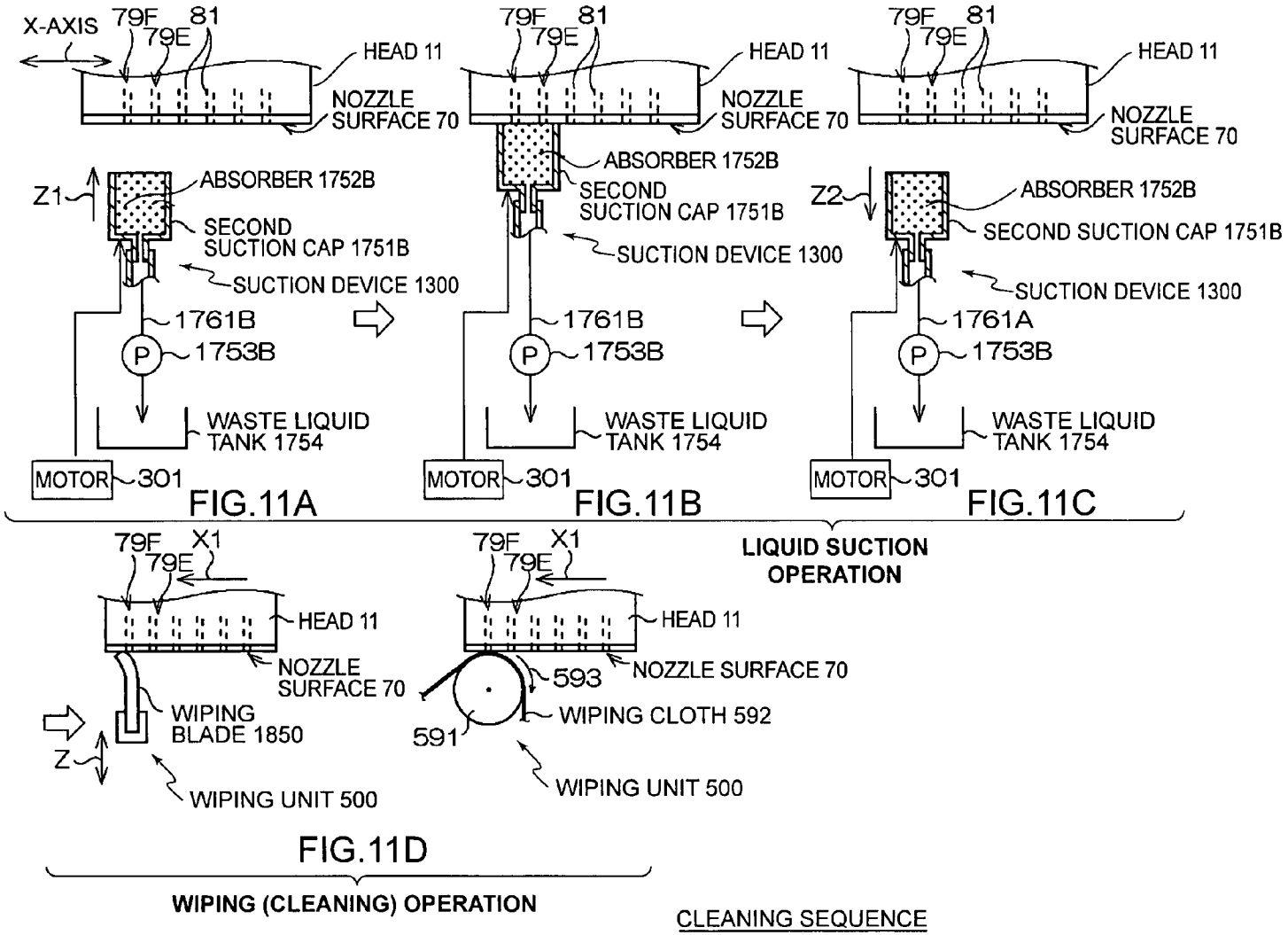
FIGS. 11A through 11D are schematics showing a way of sealing two nozzle rows and carrying out wiping after suction.

FIGS. 11A through 11C show the operation sequence of suction only from two adjacent nozzle rows 79E and 79F on the nozzle surface 70 of the head 11 by the second suction cap 1751B shown in FIG. 9. FIG. 11D shows an example of a wiping operation with the wiping blade 1850 for a part of the nozzle surface 70 of a head portion including the nozzle rows 79E and 79F.

In FIGS. 10A through 10 and 11A through 11D, the suction operation and wiping operation constitute a cleaning operation for the nozzle surface 70 and nozzles of each nozzle row.

The wiping blade 1850 shown in FIGS. 10D and 11D is provided in the wiping unit 500. In the wiping unit 500, the wiping blade 1850 is vertically moved along the Z-axis direction by a driving unit (not shown), for example. Thereby a tip of the wiping blade 1850 closely contacts with the nozzle surface 70 so as to be elastically deformed. Thus, the movement of the head 11 along direction X1, for example, enables the tip of the wiping blade 1850 to wipe the nozzle surface 70.

For the wiping unit 500, a wiping cloth 592 may be substituted for the wiping blade 1850, as shown in FIGS. 10D and 11D. The wiping cloth 592 is moved by a wiping roller 591 along an arrow 593 in an endless manner. This movement of the wiping cloth 592 allows the wiping of the nozzle surface 70. Either the wiping blade 1850 or the wiping cloth 592 may be used. The wiping blade 1850 is made of an elastically deformable material, such as rubber or elastomer.

Figure 12:
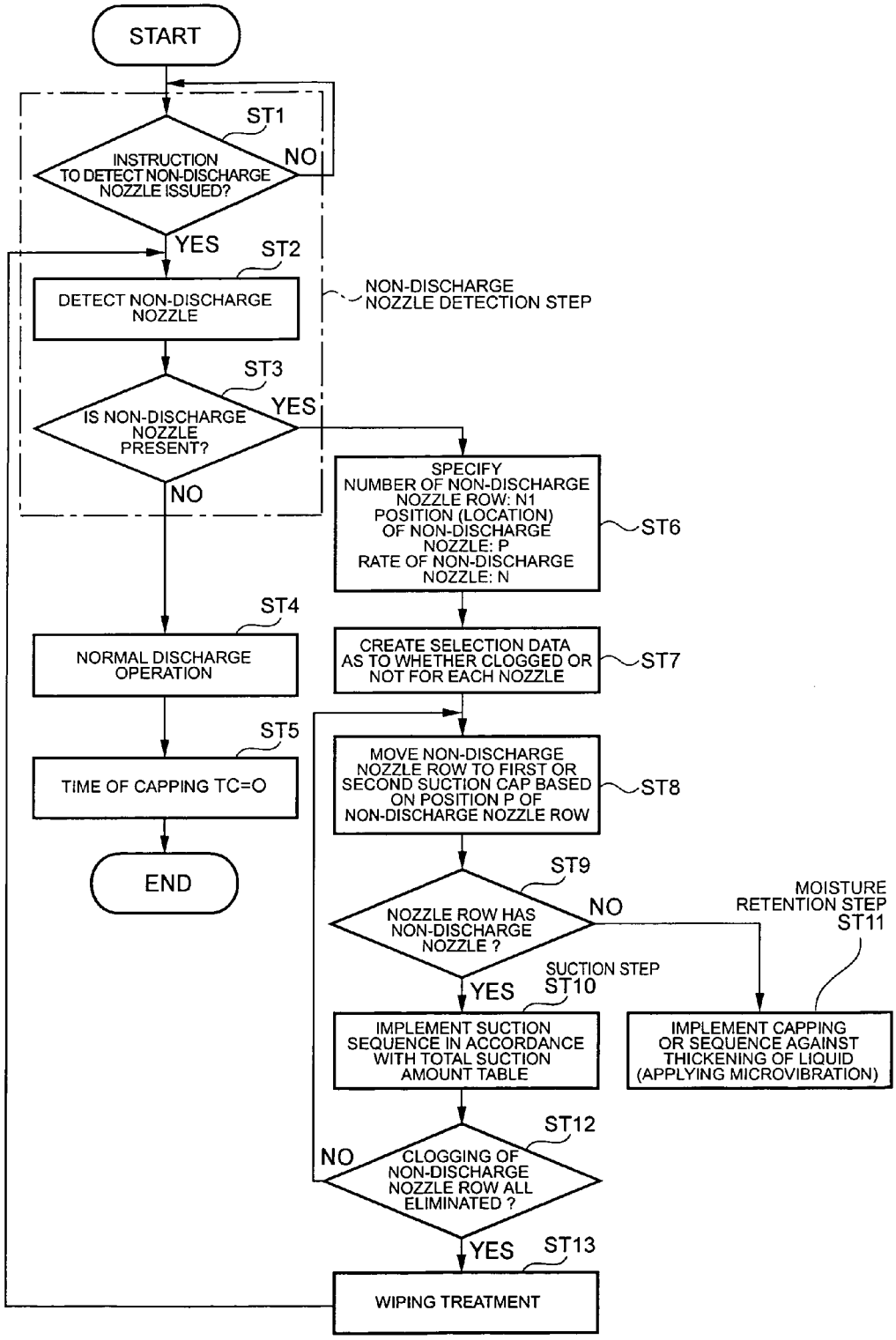
FIG. 12 is a schematic showing an operational example to maintain the discharge performance of a nozzle surface of a droplet discharge device.

FIG. 12 is a flow chart showing one example of a method to maintain the discharge performance of a head implemented with an exemplary embodiment of the droplet discharge device of an exemplary aspect of the present invention.

FIG. 13 shows one example of the dependence of total suction amounts from one nozzle row including clogged nozzles on the length of time of capping TC immediately until droplet discharge operation by the droplet discharge device. Table A showing the total suction amounts is stored in the information storage 1810 shown in FIG. 7.

Table A of FIG. 13 shows modes 1 through 5 by way of example. In the mode 1 of FIG. 13, an abnormal case is shown in which the time of capping TC immediately until a droplet discharge operation is irrelevant, and the head of FIG. 1 is not positioned at a home position HP (out of home position) but allowed to stand in other regions. In this case, the total suction amount from one nozzle row is 2.0 g, which is the largest. In the mode 2, the time of capping TC is at least 0 and less than three days. In the mode 3, the time of capping TC is at least three days and less than one week. In the mode 4, the time of capping TC is at least one week and less than one month. In the mode 5, the time of capping TC is at least one month. As described above, in the modes 2 through 5, the total suction amount from one nozzle row increases like 0.2, 0.6, 1.0 and 2.0 as the time of capping (time of sealing) immediately until droplet discharge operation increases.

Also, the total suction amount from one nozzle row may become larger compared with the above total suction amounts in some cases. Specifically, in the case in which the ratio of the number of non-discharge nozzles (nozzles of dot missing) in a nozzle row to the total nozzle number, N2, is above 5%, the total suction amounts (g) in the modes 1 through 5 all increase. The total suction amounts (g) increase to 3.0, 0.4, 1.2, 2.0 and 3.0 in the modes 1, 2, 3, 4 and 5, respectively.

An example of a method to maintain the discharge performance of a head will be explained with reference to FIG. 12.

Referring to FIG. 12, first, a non-discharge nozzle detection step ST0 is carried out. The detection step ST0 includes steps ST1 through ST3. If an instruction to detect non-discharge nozzles is sent from the control unit 200 of FIG. 6 to the non-discharge nozzle detector 600 in the step ST1, the sequence moves to the step ST2. In the step ST2, the non-discharge nozzle detector 600 shown in FIGS. 6 and 7 detects non-discharge nozzles from plural nozzles of nozzle rows.

In the step ST3 of FIG. 12, the control unit 200 determines the presence of non-discharge nozzles. If non-discharge nozzles are absent, the control unit 200 causes the head 11 to carry out normal discharge operation in a step ST4. Then in a step ST5, the time of capping TC immediately until droplet discharge operation in this case is set to 0. Thus, the operation sequence is completed.

In contrast, if the non-discharge nozzle detector 600 detects non-discharge nozzles in the step ST3 of FIG. 12, the sequence moves to a step ST6.

In the step ST6, the number of non-discharge nozzle rows is defined as N1, the position (location) of non-discharge nozzle rows is defined as P, and the rate of non-discharge nozzles in the non-discharge nozzle row is defined as N2.

The term non-discharge nozzle refers to a nozzle that is clogged due to the thickening of a liquid or the like and therefore can not discharge a liquid therefrom.

The term non-discharge nozzle row refers to a nozzle row including non-discharge nozzles. The position of a non-discharge nozzle row refers to a position on the nozzle surface of the head 11 obtained by specifying which nozzle row in the head portions 11A through 11F in FIG. 5 is a non-discharge nozzle row.

The rate of non-discharge nozzles refers to the rate of the number of non-discharge nozzles to the number of total nozzles in a nozzle row including non-discharge nozzles.

In order to determine the number N1 of non-discharge nozzle rows and the rate N2 of non-discharge nozzles, the control unit 200 is notified whether or not the non-discharge nozzle detector 600 shown in FIG. 6 can detect the discharging of droplets by nozzles of each nozzle row, so as to carry out computation. The position P of a non-discharge nozzle row can be determined depending on the position of the head of FIG. 1 in the X-axis and Y-axis directions with respect to the non-discharge nozzle detector 600.

In a step ST7 of FIG. 12, for a nozzle row including clogged non-discharge nozzles, the control unit 200 creates selection data as to whether clogged or not for each nozzle.

In a step ST8, the head 11 moves along the X-axis and Y-axis directions in FIG. 4 in accordance with the position P of the non-discharge nozzle rows. Thus, if the number of nozzle rows including clogged non-discharge nozzles is one, only this one nozzle row is positioned above the first suction cap 1751A shown in FIG. 4. Also, if two nozzle rows include clogged non-discharge nozzles, only the adjacent two nozzle rows are positioned above the second suction cap 1751B of FIG. 4.

Referring back to FIG. 8, for example, only one nozzle row 79F is sealed by the first suction cap 1751A. Furthermore, referring back to FIG. 9, only the adjacent two nozzle rows 79E and 79F are sealed by the second suction cap 1751B. In a step ST9 of FIG. 12, a determination is made about whether a nozzle row includes non-discharge nozzles or not. If the nozzle row including non-discharge nozzles is present, the nozzle row is sealed by the first suction cap 1751A or the second suction cap 1751B in the state shown in FIG. 8 or 9 as described above.

In a suction step ST10 of FIG. 12, a suction sequence (cleaning sequence) is carried out as shown in FIGS. 10A through 10C in accordance with the table A of total suction amount shown in FIG. 13. Otherwise, a suction sequence (cleaning sequence) is carried out as shown in FIGS. 11A through 11C.

As shown in FIG. 10A, the first suction cap 1751A is raised along the Z-axis direction toward the nozzle surface 70. When the pump 1753A is operated while the first suction cap 1751A seals the nozzle surface as shown in FIG. 10B, suction is performed on nozzles of the nozzle row 79F including clogged non-discharge nozzles and the sucked liquid is ejected toward the waste liquid tank 1754. After the negative pressure in the first suction cap 1751A is released, the first suction cap 1751A is moved away from the nozzle surface 70 in direction Z2 as shown in FIG. 10C.

In the example of FIGS. 11A through 11C, the second suction cap 1751B is raised in direction Z1 as shown in FIG. 11A. The second suction cap 1751B seals the adjacent nozzle rows 79E and 79F as shown in FIG. 11B. The operation of the suction pump 1753B causes suction from nozzles of the nozzle rows 79E and 79F, and the sucked liquid is ejected toward the waste liquid tank 1754. After the negative pressure in the second suction cap 1751B is released, the second suction cap 1751B is moved away from the nozzle surface in direction Z2 as shown in FIG. 11C.

Referring again to FIG. 12, if the clogging of the non-discharge nozzle rows is not completely eliminated in a step ST12, the sequence returns to the step ST8 and the steps to the step ST10 are carried out again.

If the clogging of non-discharge nozzles in non-discharge nozzle rows is completely eliminated in the step ST12, the sequence moves to wiping treatment of a step ST13 in FIG. 12. In the wiping treatment, the wiping blade 1850 wipes only the region of the nozzle surface 70 including recovered one nozzle row 79F as shown in FIG. 10D. In the example of FIG. 11D, the wiping blade 1850 wipes only the region of the nozzle surface 70 including the recovered nozzle rows 79E and 79F.

Specifically, the wiping blade 1850 does not wipe the whole surface of the nozzle surface 70 but wipes only a part of the nozzle surface 70 including recovered nozzle rows.

Thereafter, the sequence returns to the step ST2.

Figure 14A:
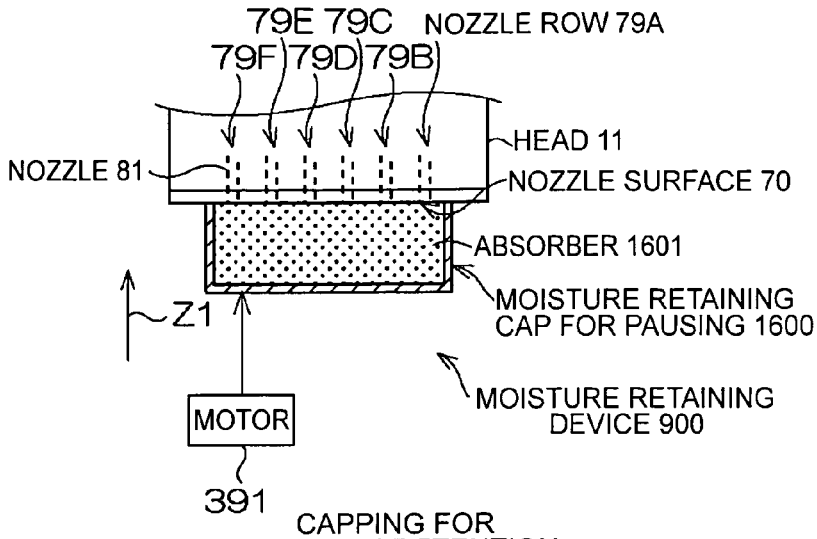
FIGS. 14A through 14C are schematics showing an example of capping to retain the moisture of a nozzle surface and a measure against the thickening of a liquid.
Figure 14B:
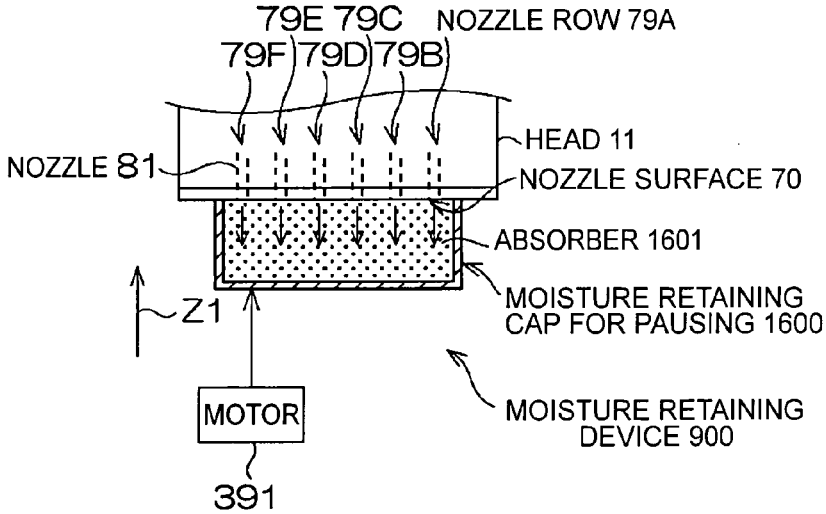
Figure 14C:
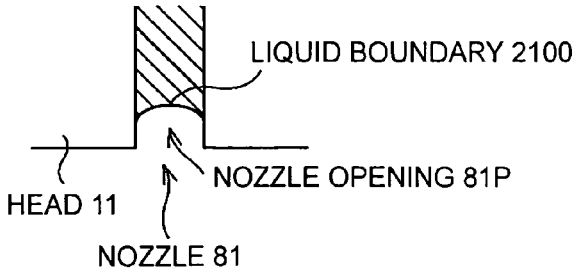

In the step ST9 of FIG. 12, if non-discharge nozzle rows are absent, the sequence moves to a moisture retention step ST11. In the moisture retention step ST11, the moisture retaining cap 1600 is used as shown in FIGS. 14A through 14C As shown in FIG. 14A, the head 11 is positioned at a position corresponding to the moisture retaining cap 1600 for pausing. The motor 391 raises the moisture retaining cap 1600 in direction Z1, and thereby the upper end of the moisture retaining cap 1600 is closely contacted with the nozzle surface 70 to seal it. Specifically, all nozzle rows 79A through 79F of the head 11 are sealed by the moisture retaining cap 1600. Thus, the use of the moisture retaining cap 1600 permits capping for all nozzle rows on the nozzle surface.

Otherwise, not only the nozzle surface is capped, but also droplets are flushed, specifically discharged from nozzles of the nozzle rows 79A through 79F to the absorber 1601 in the moisture retaining cap 1600 while the moisture retaining cap 1600 seals the nozzle surface 70 as shown in FIG. 14B. This discharging allows the liquid to retain moisture in the moisture retaining cap 1600, with the result that the moisture of each nozzle on the nozzle surface 70 can also be retained.

In this manner, droplets can be flushed from nozzles periodically. In addition to the periodical droplet flushing, microvibration is desirably applied to a liquid boundary 2100 in a nozzle opening 81P of each nozzle 81 shown in FIG. 14C.

In applying microvibration to the liquid boundary 2100, the control unit 200 operates the piezoelectric elements 420 shown in FIG. 7 disposed corresponding to the respective nozzles 81.

This microvibration reduces or prevents a liquid from being thickened in normally dischargeable nozzles and recovered nozzles. The microvibration applied to the liquid boundary 2100 is so-called non-printing microvibration (microvibration at the outside of the home position HP). The sequence against the thickening of a liquid shown in FIGS. 14A and 14B allows the waiting of head 11 while the discharge performance of the head 11 is maintained.

The exemplary embodiment of a droplet discharge device of an exemplary aspect of the present invention can be used for manufacturing an electro-optical device. Examples of the electro-optical device may include a liquid crystal display, an organic electro luminescence (EL) device, an electron-emitting device, a plasma display panel (PDP) device, and an electrophoretic display. Note that an electron-emitting device includes a so-called field emission display (FED) as a concept. Furthermore, other examples of an electro-optical device may include various devices involving the formation of metal wires, lenses, resist, light diffusers, etc. In the case of manufacturing a color filter (CF) and a liquid crystal display, ink for color filter and liquid crystal can also be discharged.

Figure 15:
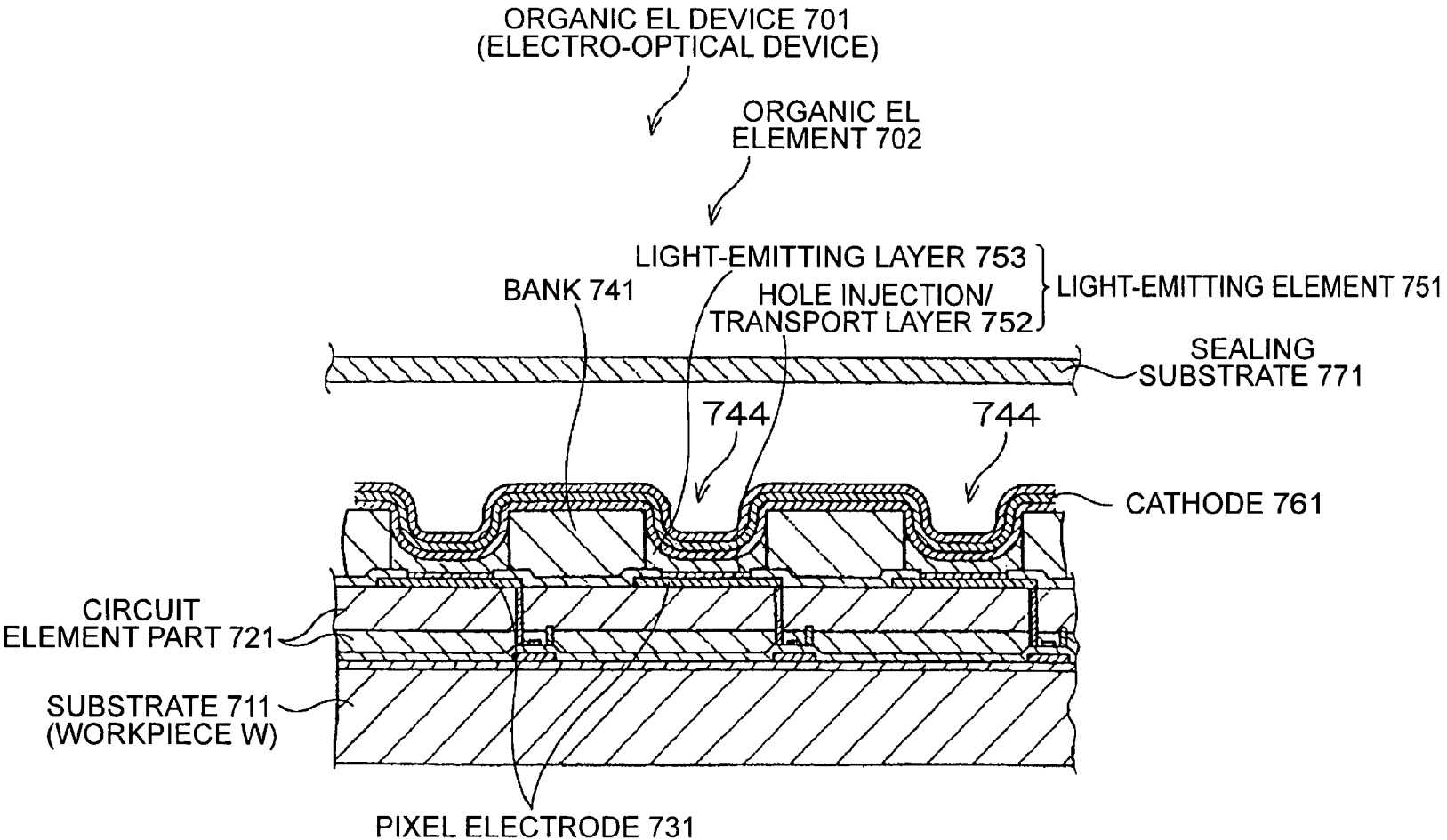
FIG. 15 is a schematic showing a configuration example of an organic EL device manufactured with a droplet discharge device of an exemplary aspect of the present invention.

FIG. 15 shows a structural example of an organic EL device, which is one type of flat panel displays, manufactured by using the droplet discharge device of an exemplary aspect of the present invention as a drawing device. An organic EL device 701 is obtained by coupling wires and driving ICs (not shown) of a flexible substrate (not shown) to an organic EL element 702. The organic EL element 702 includes a substrate 711, circuit element parts 721, pixel electrodes 731, banks 741, light-emitting elements 751, a cathode 761 (counter electrode), and a sealing substrate 771.

The circuit element parts 721 are formed on the substrate 711 of the organic EL element 702. The plural pixel electrodes 731 are arranged on the circuit element parts 721. The banks 741 are formed in a grid between the pixel electrodes 731. The light-emitting elements 751 are formed in concave openings 744 due to the banks 741. The cathode 761 is formed over the whole surfaces of the banks 741 and the light-emitting elements 751. The sealing substrate 771 is provided above the cathode 761.

A manufacturing process for the organic EL element 702 includes forming the banks 741, a plasma treatment to properly form the light-emitting elements 751, forming the light-emitting elements 751, forming the cathode 761, and providing the sealing substrate 771 above the cathode 761 to seal the element.

Specifically, to manufacture the organic EL element 702, the banks 741 are formed on predetermined positions on the substrate 711 (workpiece W) on which the circuit element parts 721 and the pixel electrodes 731 are formed in advance. Then, plasma treatment, the formation of the light-emitting elements 751, and the formation of the cathode 761 (counter electrode) are carried out in that order, and thereafter the sealing substrate 771 is provided above the cathode 761 to seal the element. Note that since the organic EL element 702 is sensitive to water and so forth in the atmosphere, the organic EL element 702 may be manufactured in the atmosphere of a dry air or an inactive gas (nitrogen, argon, helium or the like).

Each light-emitting element 751 is made up of a film part including a hole injection/transport layer 752 and a light-emitting layer 753 colored in any one of red (R), green (G) and blue (B). Forming the light-emitting element includes forming the hole injection/transport layers 752 and forming the light-emitting layers 753 of three colors.

After the organic EL element 702 is manufactured, wires of a flexible substrate is coupled to the cathode 761 of the organic EL element 702 while wires of the circuit element parts 721 are coupled to driving ICs to manufacture the organic EL device 701.

An example in which the droplet discharge device 10, which is an exemplary embodiment of the present invention, is applied to the manufacturing of a liquid crystal display will now be described.

Figure 16:
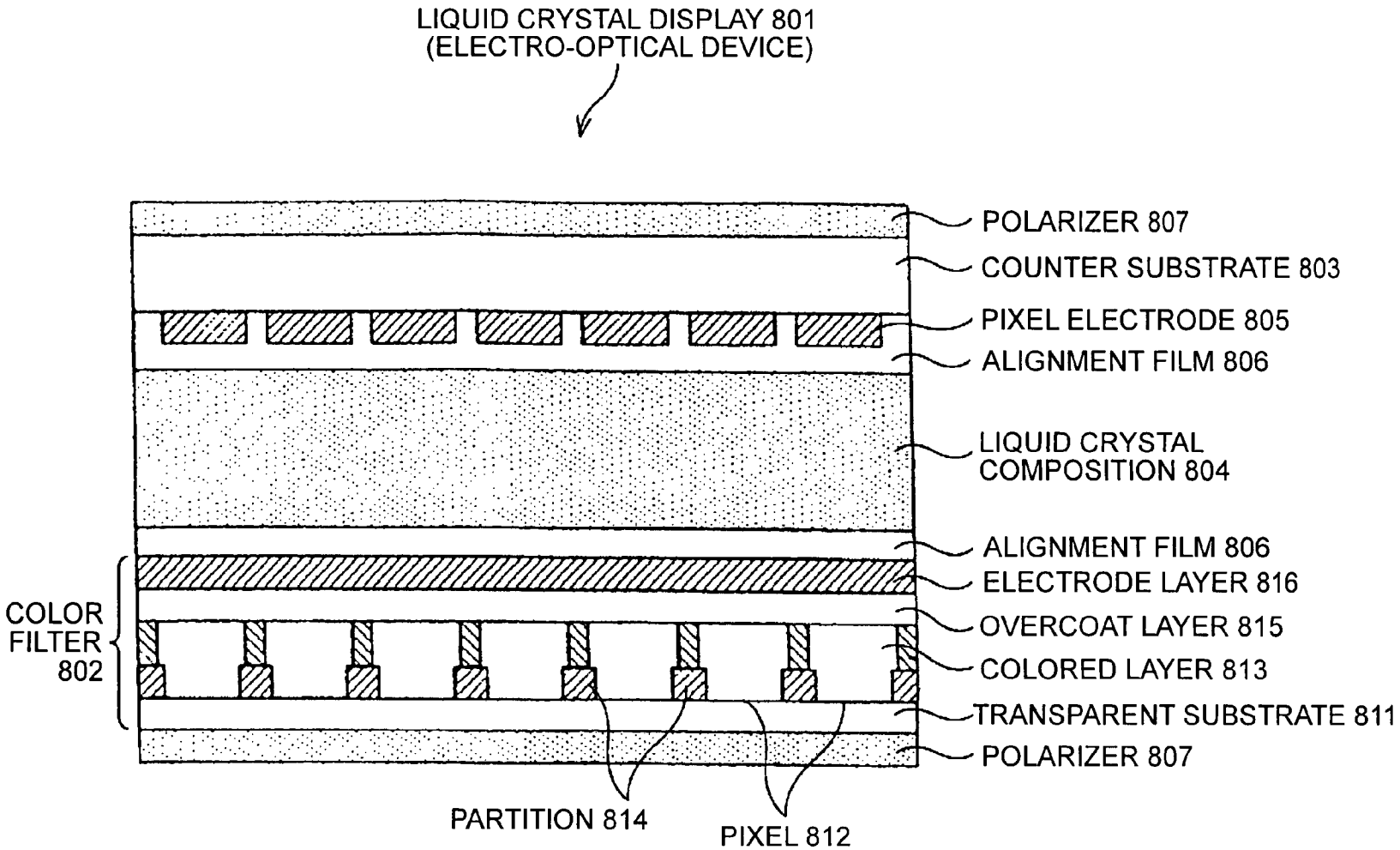
FIG. 16 is a schematic showing a configuration example of a liquid crystal display manufactured with a droplet discharge device of an exemplary aspect of the present invention.

FIG. 16 shows a schematic of a liquid crystal display 801. The liquid crystal display 801 includes a color filter 802, a counter substrate 803, a liquid crystal composition 804 enclosed between the color filter 802 and the counter substrate 803, and a backlight (not shown). Pixel electrodes 805 and thin film transistor (TFT) elements (not shown) are formed in a matrix on the inner surface of the counter substrate 803. Colored layers 813 of red, green and blue of the color filter 802 are arranged on positions facing the pixel electrodes 805. Alignment films 806 to arrange liquid crystal molecules along a certain direction are formed on the inner surfaces of the color filter 802 and the counter substrate 803. Polarizers 807 are bonded to the outer surfaces of the color filter 802 and the counter substrate 803.

The color filter 802 includes an optically transparent substrate 811, a number of pixels (filter elements) 812 arranged in a matrix on the transparent substrate 811, the colored layers 813 formed on the pixels 812 and light blocking partitions 814 to separate the pixels 812. An overcoat layer 815 and an electrode layer 816 are formed over the upper surfaces of the colored layers 813 and the partitions 814.

A method to manufacture the liquid crystal display 801 will be described. First, the partitions 814 are formed on the transparent substrate 811. Subsequently, the colored layers 813 of red (R), green (G) and blue (B) are formed on the pixels 812. Then, a transparent acrylic resin coating material is spin-coated to form the overcoat layer 815, and thereafter the electrode layer 816 composed of indium tin oxide (ITO) is formed, manufacturing the color filter 802.

The pixel electrodes 805 and TFT elements are formed on the counter substrate 803. Subsequently, after the manufactured color filter 802 and the counter substrate 803 having the pixel electrodes 805 thereon are coated with the alignment films 806, these components are attached to each other. Then, the liquid crystal composition 804 is enclosed between the color filter 802 and the counter substrate 803, and thereafter the polarizer 807 and a backlight are provided.

The exemplary embodiment of the droplet discharge device of an exemplary aspect of the present invention can be used to form filter elements (colored layers 813 of R, G and B) of the above color filter. Also, the droplet discharge device can also be used to form the pixel electrodes 805 with using a liquid material for the pixel electrodes 805.

Other examples of electro-optical devices may include a device involving, in addition to the forming of metal wires, lenses, resist, light diffusers, etc., the formation of preparations. By using the above-described droplet discharge device to manufacture various electro-optical devices, the various electro-optical apparatus can be manufactured effectively.

Electronic apparatus of exemplary aspects of the present invention incorporate the above electro-optical device. In this case, examples of the electronic apparatus include a cellular phone, a personal computer that incorporate a so-called flat panel display, and other electronic products.

Figure 17:
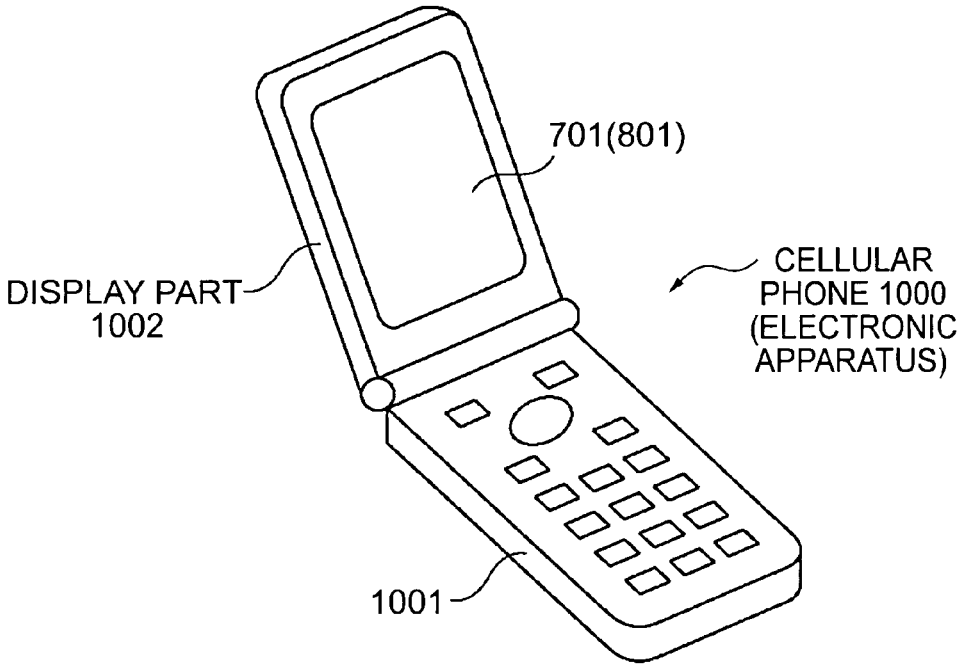
FIG. 17 is a schematic showing a cellular phone that is one example of an electronic apparatus having a display manufactured by an exemplary embodiment of the present invention.

FIG. 17 shows a configuration example of a cellular phone 1000, which is one example of electronic apparatus. The cellular phone 1000 has a main body 1001 and a display part 1002. For example, the organic EL device 701 or the liquid crystal display 801, which is the above-described electro-optical device, is used for the display part 1002.

Figure 18:
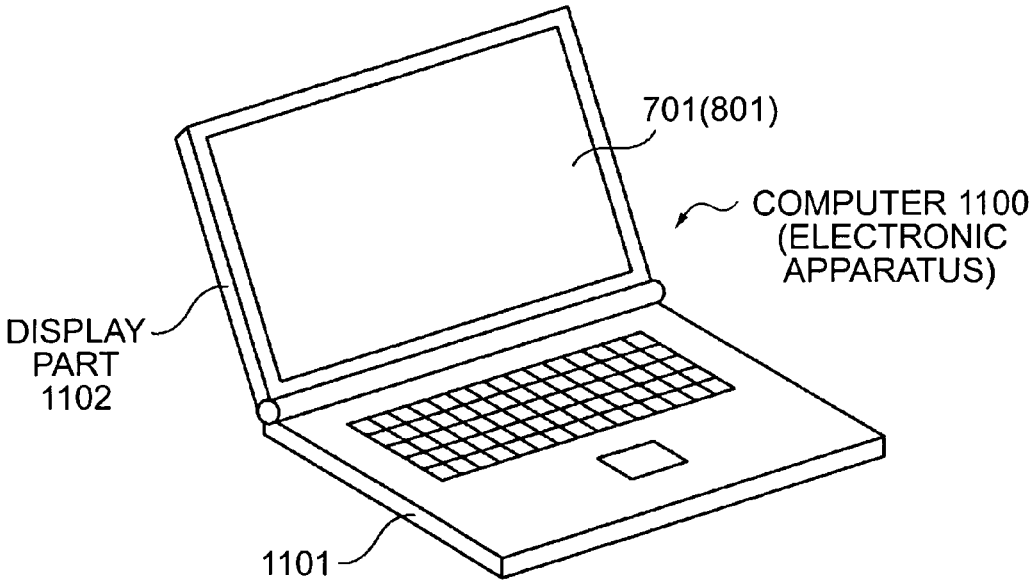
FIG. 18 is a schematic showing a computer that is another example of an electronic apparatus.

FIG. 18 shows a computer 1100, which is another example of electronic apparatus. The computer 1100 has a main body 1101 and a display part 1102. The organic EL device 701 or the liquid crystal display 801, which is the above-described electro-optical device, is used for the display part 1102.

The exemplary embodiment of the droplet discharge device of an exemplary aspect of the present invention includes a head to discharge minute droplets stably and correctly. In order to suppress the clogging of nozzles in the head, clogged nozzles and the nozzle row including the clogged nozzles are detected based on so-called dot missing detection (non-discharge nozzle detection) before droplet discharge operation.

In the above-described exemplary embodiment, an example of discharging droplets to a workpiece of an electro-optical device has been illustrated.

The present invention is not limited to this exemplary embodiment. For example, the droplet discharge device of an exemplary aspect of the present invention can also be used for the case of carrying out printing for a workpiece by using liquids of plural kinds. An explanation will be made about an example in which the exemplary embodiment of the droplet discharge device of an exemplary aspect of the present invention discharges plural liquids to a workpiece or an object to be printed as a target, for example.

In the related art, if the number of clogged nozzles, specifically the number of non-discharge nozzles in a head is large, the clogging of nozzles can not be eliminated in some cases no matter how many times cleaning sequences are carried out. This state is caused when the thickening of a liquid in nozzle openings proceeds to the extent that the liquid is solidified, and the liquid solidification extends into the cavity of the head. Also, when a head has four nozzle rows to discharge liquids of four colors, for example, suction is performed on four nozzle rows simultaneously with one cap. If the recovery characteristics of all colors as to clogging are the same, suction with the same suction force from each nozzle row does not lead to a problem. However, if only magenta (M) of four colors has a poor recovery characteristic, suction of a liquid from nozzle openings corresponding to magenta becomes impossible while respective liquids are sucked from nozzle openings of other three colors of black (BK), cyan (C) and yellow (Y). In order to reduce or eliminate the clogging of nozzle openings for magenta, the nozzle rows of four colors need be collectively cleaned a number of times.

However, by using the exemplary embodiment of an exemplary aspect of the present invention, nozzle rows including clogged nozzles in a head having plural nozzle rows are detected in advance, and suction is solely performed on the nozzle rows including the clogged nozzles independently of normally dischargeable nozzle rows. Thereby recovery treatment for clogged nozzles can be carried out while measures against the thickening of a liquid can be carried out for nozzle rows having no clogged nozzles.

In an exemplary embodiment of the present invention, the head is moved relative to the suction device and moisture retaining device by using the first and second operation units 21 and 22 of FIG. 1. Thus, the head can surely be aligned with the suction device and the moisture retaining device.

When nozzle rows having clogged non-discharge nozzles are caused in a head, suction can be taken from the nozzle rows with the suction device near a workpiece to eliminate the clogging. Thus, suction from the clogged nozzle rows can be carried out near a workpiece and therefore the movement amount of a head can be reduced. In addition, since the suction device is located near a workpiece, the droplet discharge device can be miniaturized.

In an exemplary embodiment of the present invention, the first or second suction cap is selected and is used for a suction operation corresponding to either the case in which the number of nozzle rows including non-discharge nozzles is one, or the case in which that is two or more. Thereby suction can be taken from nozzle rows efficiently to eliminate clogging. Furthermore, there is no need to take suction from normal nozzle rows collectively with clogged nozzle rows. Therefore, the suction device can be miniaturized and a waste of a liquid caused by liquid emission due to suction can be decreased. Specifically, the consumption amount of a liquid wasted when recovering the droplet discharge characteristic of a head can be reduced drastically.

In the present exemplary embodiment, the wiping device does not wipe the whole surface of a nozzle surface but wipes a part of the nozzle surface after the suction device takes suction from clogged nozzle rows, reducing or preventing the wear of the nozzle surface.

In an exemplary embodiment of the present invention, the thickening of a liquid in each nozzle can surely be reduced or prevented by discharging droplets and applying microvibration to liquid boundaries. The longer the pause time of a head is, the more the suction amount from a nozzle surface is increased. Thus, recovery treatment for clogged nozzles can surely be carried out. If the number of non-discharge nozzles in a nozzle row is above a certain value, the suction amount from a nozzle surface is increased. Thereby, recovery treatment for the clogged non-discharge nozzles can be carried out more surely.

Also in, for example, ink-change cleaning in FIG. 12 in the exemplary embodiment of the present invention in which an ink as a liquid is changed, suction can be carried out for clogged nozzle rows in manner of the table A for total suction amounts of FIG. 13. In the exemplary embodiment of the present invention, when clogged nozzles are caused and the clogging of nozzles is to be eliminated by using an ink-like liquid, the usage amount of the liquid can be reduced drastically.

It is sufficient that the wiping of a nozzle surface is carried out for a part of the head including nozzle rows having nozzles from which clogging is eliminated. Therefore, the wiping time is shortened and the wear of the wiping member and the wear of nozzle surface of the head can be reduced or prevented. Also, if nozzle rows including non-discharge nozzles are absent although the head is at the home position HP, that is, the head is not capped by the moisture retaining cap 1600 of the moisture retaining device 900 in the maintenance unit of FIGS. 14A through 14C, the suction operation for the nozzle surface is unnecessary.

Compared with the case in which suction mechanisms for cleaning are provided for all nozzle rows in a so-called multiple head shown in FIG. 4, lower costs and a device with a smaller size can be achieved since suction is taken only from nozzle rows having clogged nozzles.

It should be understood that the present invention is not limited to the above-described exemplary embodiments, and various modifications can be made without departing from the scope. In addition, the above described exemplary embodiments may be combined with each other.

What is claimed is:

1. A droplet discharge device to discharge a droplet to a workpiece, comprising:

a head including a plurality of nozzle rows that have a plurality of nozzles on a nozzle surface in order to discharge the droplet of a supplied liquid;

an optical non-discharge nozzle detector to detect a nozzle row of the plurality of nozzle rows having a clogged nozzle as a non-discharge nozzle;

a suction device to seal the nozzle row including the non-discharge nozzle that is detected on the nozzle surface and performing suction from the nozzle row to eliminate clogging of the non-discharge nozzle; and a moisture retaining device to seal the plurality of nozzle rows on the nozzle surface to retain moisture of the nozzle surface, wherein;

the droplet being discharged into the moisture retaining device and microvibration being applied to a liquid boundary in a one nozzle of the nozzle row by a driving element for discharge a droplet provided for the one nozzle, in order to prevent thickening of the liquid in the one nozzle that is not clogged and is normal in the nozzle row and prevent thickening of the liquid in the one nozzle from which clogging has been eliminated in the nozzle row.

2. The droplet discharge device according to claim 1, further comprising:

an operation unit to move the head relative to the suction device so as to align the nozzle row including the non-discharge nozzle with the suction device, and move the head relative to the moisture retaining device so as to align the plurality of nozzle rows with the moisture retaining device.

3. The droplet discharge device according to claim 1, the suction device being located near a position of the workpiece.

4. The droplet discharge device according to claim 1 the suction device including:

a first suction cap to perform suction on one nozzle row including the non-discharge nozzle; and a second suction cap to perform suction simultaneously on a plurality of the nozzle rows including the non-discharge nozzle.

5. The droplet discharge device according to claim 4, further comprising:

a wiping device to wipe the part of the nozzle surface having the nozzle row including the non-discharge nozzle after suction by the suction device.

6. The droplet discharge device according to claim 4, an amount of suction from the nozzle surface by the suction device being increased depending on a pause time of the head immediately until an operation of discharging the droplet to the workpiece.

7. The droplet discharge device according to claim 6, an amount of suction from the nozzle surface by the suction device being increased if a rate of the non-discharge nozzle in the nozzle row is above a predetermined certain value.

8. A device to maintain discharge performance of a head with a nozzle surface, the device including a droplet discharge device to discharge a droplet from the head to a workpiece, comprising:

an optical non-discharge nozzle detector detecting a nozzle row in the head having a clogged nozzle as a non-discharge nozzle, the head including a plurality of nozzle rows that have a plurality of nozzles on the nozzle surface in order to discharge the droplet of a supplied liquid;

a suction device to seal the nozzle row including the non-discharge nozzle on the nozzle surface and taking suction from the nozzle row to eliminate clogging of the non-discharge nozzle; and a moisture retaining device to seal the plurality of nozzle rows on the nozzle surface to retain moisture of the nozzle surface, wherein;

the droplet being discharged into the moisture retaining device and microvibration being applied to a liquid boundary in a one nozzle of the nozzle row by a driving element for discharge a droplet provided for the one nozzle, in order to prevent thickening of the liquid in the one nozzle that is not clogged and is normal in the nozzle row and prevent thickening of the liquid in the one nozzle from which clogging has been eliminated in the nozzle row.

9. A method to maintain discharge performance of a head with a nozzle surface in a droplet discharge device to discharge a droplet from the head to a workpiece, comprising:

detecting, by an optical non-discharge nozzle detector, a nozzle row in the head having a clogged nozzle as a non-discharge nozzle, the head including a plurality of nozzle rows that have a plurality of nozzles on the nozzle surface in order to discharge the droplet of a supplied liquid;

sealing, by a suction device, the nozzle row including the non-discharge nozzle on the nozzle surface and taking suction from the nozzle row to eliminate clogging of the non-discharge nozzle; and sealing, by a moisture retaining device, the plurality of nozzle rows on the nozzle surface to retain moisture of the nozzle surface, wherein;

the droplet being discharged into the moisture retaining device and microvibration being applied to a liquid boundary in a one nozzle of the nozzle row by a driving element for discharge a droplet provided for the one nozzle, in order to prevent thickening of the liquid in the one nozzle that is not clogged and is normal in the nozzle row and prevent thickening of the liquid in the one nozzle from which clogging has been eliminated in the nozzle row.

10. A method to manufacture an electro-optical device, using a droplet discharge device to discharge a droplet from a head to a workpiece the method, comprising:

detecting, by an optical non-discharge nozzle detector, a nozzle row in the head having a clogged nozzle as a non-discharge nozzle, the head including a plurality of nozzle rows that have a plurality of nozzles on a nozzle surface in order to discharge the droplet of a supplied liquid;

sealing, by a suction device, the nozzle row including the non-discharge nozzle on the nozzle surface and taking suction from the nozzle row to eliminate clogging of the non-discharge nozzle;

sealing, by a moisture retaining device, the plurality of nozzle rows on the nozzle surface to retain moisture of the nozzle surface; and discharging the droplet to the workpiece to manufacture an electro-optical device, wherein;

the droplet being discharged into the moisture retaining device and microvibration being applied to a liquid boundary in a one nozzle of the nozzle row by a driving element for discharge a droplet provided for the one nozzle, in order to prevent thickening of the liquid in the one nozzle that is not clogged and is normal in the nozzle row and prevent thickening of the liquid in the one nozzle from which clogging has been eliminated in the nozzle row.

11. An electro-optical device manufactured by using a droplet discharge device to discharge a droplet from a head to a workpiece, and manufactured by a method, the method comprising:

detecting, by an optical non-discharge nozzle detector, a nozzle row in the head having a clogged nozzle as a non-discharge nozzle, the head including a plurality of nozzle rows that have a plurality of nozzles on a nozzle surface in order to discharge the droplet of a supplied liquid;

sealing, by a suction device, the nozzle row including the non-discharge nozzle on the nozzle surface and taking suction from the nozzle row to eliminate clogging of the non-discharge nozzle;

sealing, by a moisture retaining device, the plurality of nozzle rows on the nozzle surface to retain moisture of the nozzle surface; and discharging the droplet to the workpiece, wherein;

the droplet being discharged into the moisture retaining device and microvibration being applied to a liquid boundary in a one nozzle of the nozzle row by a driving element for discharge a droplet provided for the one nozzle, in order to prevent thickening of the liquid in the one nozzle that is not clogged and is normal in the nozzle row and prevent thickening of the liquid in the one nozzle from which clogging has been eliminated in the nozzle row.

12. An electronic apparatus, comprising:

the electro-optical device according to claim 11.

* * * * *